US007594645B2

(12) United States Patent
Suzuki et al.

(10) Patent No.: US 7,594,645 B2
(45) Date of Patent: Sep. 29, 2009

(54) SHEET PROCESSING DEVICE AND IMAGE FORMATION APPARATUS

(75) Inventors: Toshimasa Suzuki, Kashiwa (JP); Yusuke Obuchi, Abiko (JP); Daisaku Kamiya, Abiko (JP); Hitoshi Fujimoto, Abiko (JP); Kiyoshi Watanabe, Kashiwa (JP); Tomokazu Nakamura, Matsudo (JP); Kenichi Hayashi, Abiko (JP); Hideki Kushida, Moriya (JP); Atsuteru Oikawa, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 753 days.

(21) Appl. No.: 11/066,131

(22) Filed: Feb. 24, 2005

(65) Prior Publication Data

US 2005/0189688 A1 Sep. 1, 2005

(30) Foreign Application Priority Data

Feb. 27, 2004 (JP) ..... 2004-055559

(51) Int. Cl.
*B65H 37/04* (2006.01)

(52) U.S. Cl. ..... 270/37; 270/32; 270/58.07; 270/58.09

(58) Field of Classification Search ..... 270/32, 270/37, 58.07, 58.09
See application file for complete search history.

(56) References Cited

U.S. PATENT DOCUMENTS

| | | | | |
|---|---|---|---|---|
| 2,066,620 | A | 1/1937 | Grammer | |
| 2,088,904 | A * | 8/1937 | Grammer | 281/15.1 |
| 5,129,876 | A * | 7/1992 | Brabant et al. | 493/471 |
| 6,692,208 | B1 | 2/2004 | Watkiss et al. | |
| 6,837,840 | B2 * | 1/2005 | Yonekawa et al. | 493/444 |
| 6,905,118 | B2 * | 6/2005 | Yamada et al. | 270/8 |
| 2002/0050677 | A1 * | 5/2002 | Sato et al. | 270/58.08 |
| 2003/0031532 | A1 * | 2/2003 | Nolte et al. | 412/33 |
| 2004/0070133 | A1 * | 4/2004 | Yamada et al. | 270/32 |
| 2004/0183246 | A1 * | 9/2004 | Jung et al. | 270/37 |

* cited by examiner

*Primary Examiner*—Gene Crawford
*Assistant Examiner*—Leslie A Nicholson, III
(74) *Attorney, Agent, or Firm*—Canon USA Inc IP Div

(57) ABSTRACT

A sheet processing device includes a pair of gripping rollers which can grip and convey a sheet bundle in a booklet-like form, a pressing roller which presses and flattens the folded back portion of the sheet bundle gripped by the gripping rollers, and a control unit which performs rotation control on the pair of gripping rollers. The control unit controls the gripping rollers so as to stop when the folded back portion of the sheet bundle protrudes from the rollers by a predetermined amount. The pressing roller flattens down the protruding folded back portion when the gripping rollers are stopped by the control unit and is in the state of gripping the sheet bundle.

16 Claims, 20 Drawing Sheets

8
6
212(209)
161
S
230
107
204
(205)
ST
161a
204b
(205b)
Sb
B
C
A
111
222
221
223

SHEET PROCESSING DEVICE AND IMAGE FORMATION APPARATUS

CROSS-REFERENCE TO RELATED APPLICATIONS

This application is related to U.S. Patent Application, entitled "Folded Back Portion Flattening Device, Sheet Processor, And Image Forming Apparatus", filed concurrently herewith, and is incorporated in its entirety by reference herein.

BACKGROUND OF THE INVENTION

1. Field of the Invention

The present invention relates to a sheet processing device which flattens down a folded back portion of a folded and curved sheet bundle, and an image formation apparatus incorporating this device. In particular, the present invention relates to a sheet processing device which flattens down the folded back portion of the sheet bundle, the sheet processing device including a function for sending the sheet bundle through a gripping roller pair and a function for gripping the sheet bundle when flattening down the folded back portion of the sheet bundle with a pressing unit, and to an image formation apparatus.

2. Description of the Related Art

Conventionally, sheets of a predetermined number (e.g., around twenty) are stacked and folded into booklet-like form with stitching/folding equipment. The sheet bundles that are folded down with such stitching/folding equipment include sheet bundles that are simply folded, sheet bundles that are saddle-stitched and folded, sheet bundles that are not bound with string or staples but are glued (perfect binding) and folded, and so forth.

However, all types of sheet bundles possess some degree of resilience, and accordingly, following folding, the area of the curved folded back portion (folded tip portion, back cover) bulges and bends and forms a U-shape, and tends to form a small opening on the open side of the folded sheet bundle. Such sheet bundles become unstable when bundled and collapse easily, and storage and conveying of such sheet bundles have been troublesome.

To solve this problem so that the folded sheet bundles can be placed flat, a folded back flattening processing device that flattens down the folded back portion of the folded sheet bundles is known (see U.S. Pat. No. 6,692,208).

As illustrated as an example in FIG. 17, a conventional folded back flattening processing device 901 is integrated into a sheet processing device 920. Further, the sheet processing device 920 is connected to a main device unit 922 of a photocopier 921 (image formation apparatus). The photocopier 921 forms images on the sheets. This conventional sheet processing device 920 forms booklet-like sheet bundles as illustrated in FIGS. 17 and 20.

The sheet processing device 920 receives and makes bundles S with a saddle tray 960 from sheets that are sent in order and having an image formed by the main device unit 922. The center of the sheet bundle is bound with a stapler 962. Then, the sheet bundle is conveyed in the lower direction, and is received and stopped by a stopper 963. After this, an abutting plate 961 abuts the bound portion of the sheet bundle, and presses the sheet bundle into a nip portion of a folding roller pair 907. The folding roller pair 907 folds the sheet bundle with the nip portion while discharging the sheet bundle to a discharge belt pair 906. The folded sheet bundle S is conveyed in the direction of arrow B with the folded back portion Sb at the leading edge, by the discharge belt pair 906, and is sent through one pair of separated gripping members 902 and 903 (FIG. 19A). Then the folded back portion Sb of the sheet bundle S is received by a stopping plate 905 and stops. The discharge belt pair 906 then stops conveying the sheet bundle, and the pair of gripping members 902 and 903 grip the sheet bundle. At this time, the folded back portion Sb protrudes from the gripping members 902 and 903.

After this, the stopping plate 905 rises and separates from the folded back portion Sb (FIG. 19B). Then, a pressing roller 904 runs along the folded back portion Sb in the direction of the arrow A while pressing the folded back portion Sb, and flattens down the curved folded back portion Sb (FIGS. 18, 19B, and 20). Finally, the discharge belt pair 906 discharges the processed sheet bundle S onto a discharge sheet tray 908 (FIG. 19C).

As described above, the gripping members 902 and 903 of the conventional sheet processing device 920 only functions to grip the sheet bundle S.

Thus, the conventional sheet processing device 920 have the gripping members 902 and 903 which only function to grip the sheet bundle S, therefore necessitating the discharge belt pair 906 as a sheet conveying device for discharging the sheet bundle from the gripping members 902 and 903, increasing the size and complexity of the configuration of the device. This further has led to increased overall size of the image formation apparatus having such a sheet conveying device.

SUMMARY OF THE INVENTION

The present invention provides a sheet processing device, wherein the configuration of the device is simple and compact, having a function for conveying a sheet bundle to a conveying rotary member pair, and a function for gripping the sheet bundle while the folded back portion of the sheet bundle is being flattened down with a pressing unit.

The present invention also provides for a compact image formation apparatus incorporating a sheet processing device having a simple and compact configuration.

In one aspect of the present invention, a sheet processing device is operable to process a sheet bundle in a booklet-like form and having a folded back portion. The sheet processing device includes a conveying rotary member configured to grip and convey the sheet bundle, a pressing unit configured to press and flatten the folded back portion of the sheet bundle gripped by the conveying rotary member, and a control unit controlling the conveying rotary member. The control unit controls the conveying rotary member to stop conveying the sheet bundle when the folded back portion of the sheet bundle protrudes from the conveying rotary member by a predetermined amount. The pressing unit flattens down the protruding aforementioned folded back portion while the conveying rotary member pair is stopped by the control unit and is gripping the sheet bundle.

In another aspect of the present invention, an image formation apparatus includes an image forming unit configured to form images on a sheet, and the sheet processing device described above which flattens down the folded back portion of a sheet bundle in the booklet-like form and having images formed thereon by the image forming unit.

The sheet processing device according to the present invention has a function wherein the conveying rotary member grips and rotationally conveys the sheet bundle in booklet-like form, and a function wherein the conveying of the sheet bundle is temporarily stopped and the sheet bundle is gripped while the pressing unit is pressing the folded back portion of the sheet bundle, and therefore the configuration can be simplified, use of space is more efficient, and the device can be made more compact.

The image formation apparatus according to the present invention includes a sheet processing device wherein the configuration is simplified and compact, and therefore the device can be more compact and space-efficient.

Further features and advantages of the present invention will become apparent from the following description of exemplary embodiments with reference to the attached drawings.

DESCRIPTION OF THE EMBODIMENTS

Figure 1:
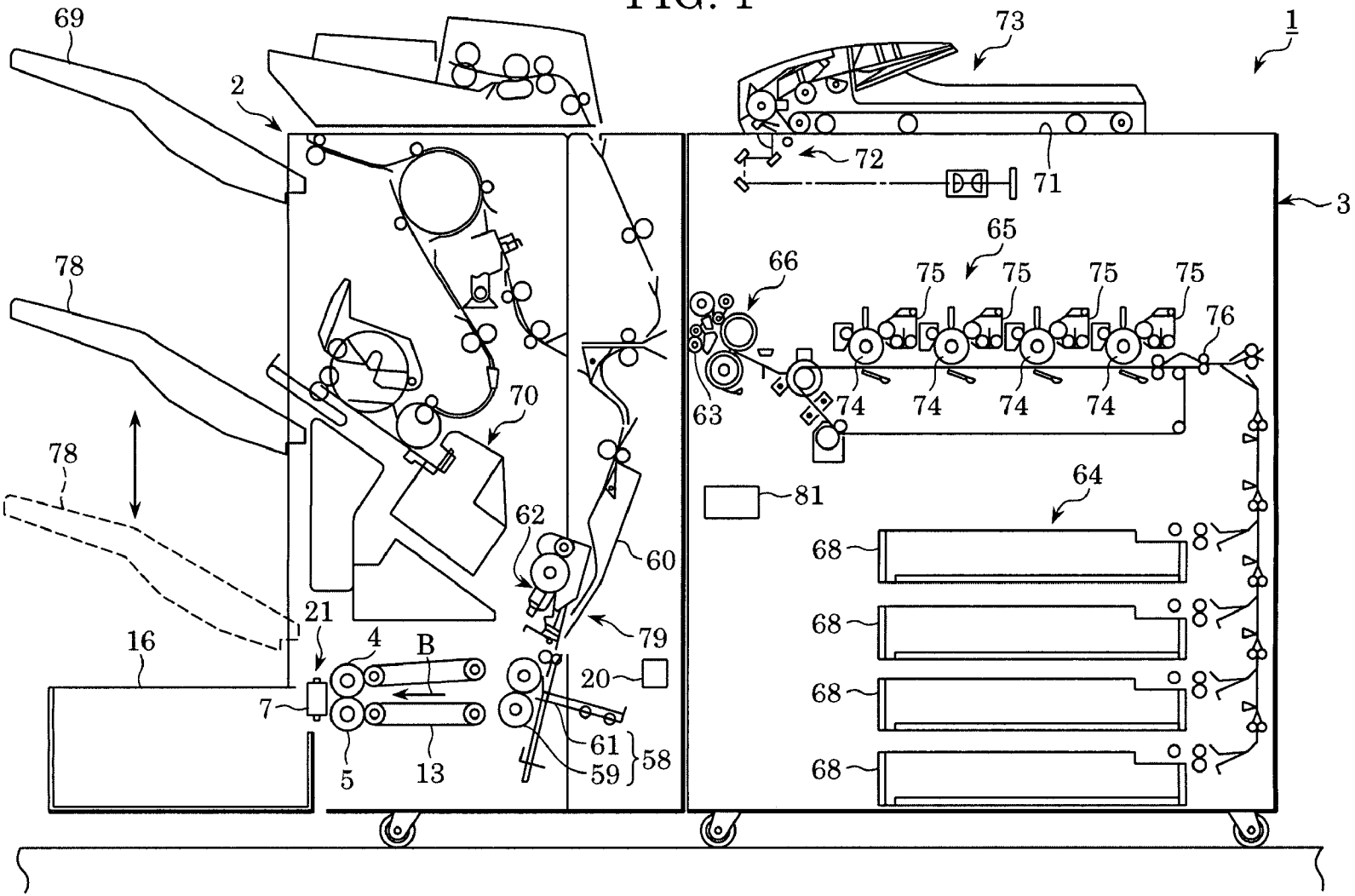
FIG. 1 is a schematic cross-sectional front view of a photocopier incorporating a sheet processing device according to a first embodiment of the present invention.

The sheet processing device according to the first embodiment of the present invention, and a photocopier incorporating the sheet processing device, will be described below while referencing the diagrams.

Photocopier (Configuration of Photocopier)

A photocopier, which is one example of an image formation apparatus, incorporating a sheet processing device according to a first embodiment of the present invention will be described based on FIG. 1. A photocopier 1, such as a full color photocopier, includes platen glass 71 serving as an original document table, a light source and lens system 72, a sheet supply unit 64, a resist roller pair 76, an image forming unit 65, an automatic document feeding device (ADF) 73 that automatically feeds documents to the platen glass 71, a sheet processing device 2 that processes the sheets whereupon an image has been formed and discharged from a main device unit 3 of the photocopier 1, a photocopier control unit 81 that controls the entire photocopier 1, and the like.

The sheet supply unit 64 has multiple cassettes 68 that store sheets for recording, and that are detachable from the main device unit 3. The image forming unit 65 includes cylindrical photosensitive drums 74, and developing units 75 supporting various colors of yellow, magenta, cyan, and black positioned surrounding the photosensitive drums 74. On the downstream side of the image forming unit 65, a fixing device 66 that fixes onto the sheet a color toner image transferred from the photosensitive drums 74, a discharge roller pair 63 that discharges the sheet, and the like, are positioned.

(Operations of Photocopier)

Upon a sheet supply signal being output from the main device unit 3 of the photocopier 1, a sheet is supplied from the cassette 68 to the resist roller pair 76. Meanwhile, light, illuminated from the light source and lens system 72 onto the document placed on the original document table 71 and is reflected therefrom, passes through the light source and lens system 72, is subjected to signal processing, and is irradiated onto the photosensitive drum 74 from a write optical system (not shown). The photosensitive drum 74 is charged beforehand by a primary charger (not shown), and a electrostatic latent image is formed on the photosensitive drum by irradiation of light. The electrostatic latent image on the photosensitive drum 74 is developed by the developing unit 75 and becomes a toner image.

After the sheet that is supplied from the sheet supply unit 64 has its angle corrected by the resist roller pair 76, the sheet is sent to the image forming unit 65 while matching the timing to the position of the toner image of the photosensitive drum 74, and the color toner image of the photosensitive drum 74 is transferred thereupon. Then the color toner image is permanently fixed onto the sheet by the fixing device 66. The sheet whereupon the color toner image is fixed is discharged from the main device unit 3 by the discharge roller pair 63. Thus, the sheet supplied from the sheet supply unit 64 receives a color toner image formed thereupon, and is sent from the main device unit 3 to the sheet processing device 2.

Now, the sheet processing device denoted by the reference numeral 2 is a sheet processing device of the first embodiment. Alternatively, a sheet processing device 102 (see FIG. 6) of a second embodiment may also be connected to the main device unit 3.

Sheet Processing Device of the First Embodiment (Configuration of Sheet Processing Device of First Embodiment)

As illustrated in FIG. 1, the sheet processing device 2 includes a fixed tray 69 to which a sheet upon which an image has been formed is discharged and stacked, having been discharged from the discharge roller pair 63 of the main device unit 3 by passing through the sheet processing device 2, a stapler 70 that binds the sheets formed into a bundle after being discharged from the main device unit 3, a stacking tray 78 capable of being raised or lowered and supporting the sheet bundles bound by the stapler 70, a binding device 79 that binds the sheets that are discharged from the main device unit 3 in bundle form, a folding device 58 that folds the bound sheet bundle in half, a folded back flattening processing device 21 of the present embodiment, a processing device control unit 20 that controls the entire sheet processing device 2, and so forth.

Now, the processing device control unit 20 can be built into the photocopier control unit 81 and provided in either the main device unit 3 or the sheet processing device 2 of the photocopier 1. Further, bundled sheets may be discharged and stacked on the stacking tray 78 without being bound by the stapler 70.

Figure 3A:
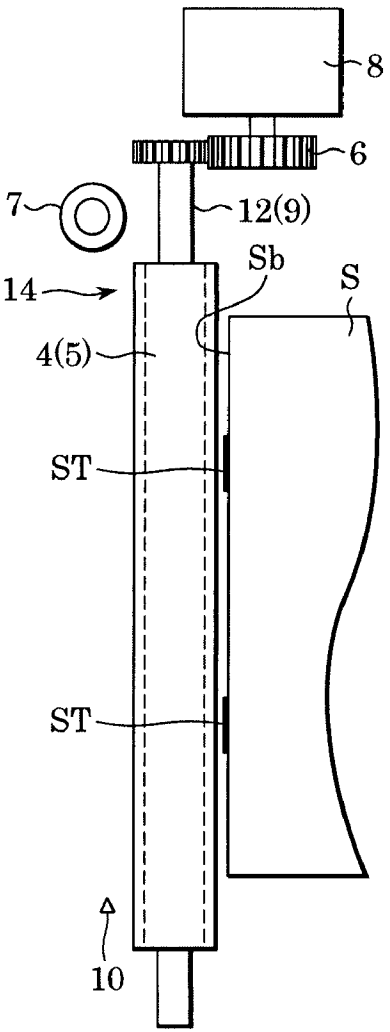
FIGS. 3A through 3D are plan views and action description diagrams of the folded back portion flattening processing device illustrated in FIG. 1.
Figure 3B:
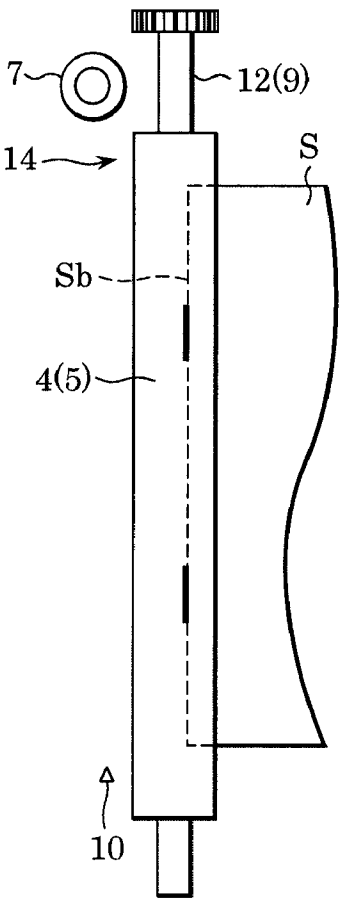
Figure 3C:
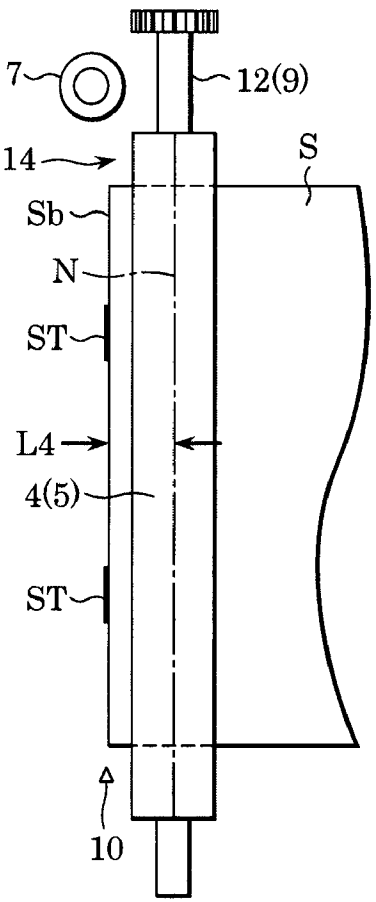

The binding device 79 includes a saddle tray 60 and a stapler 62. The binding device 79 bundles the multiple sheets discharged from the discharge roller pair 63 into a bundle, and then binds the bundle in the middle. While two positions are bound in the present embodiment, the present invention is by no means restricted to this. The member denoted by ST in FIGS. 3A and 3C is a binding staple.

The folding device 58 serving as a folding unit includes an abutting plate 61 and a folding roller pair 59, and is configured so that the bound portion of the sheet bundle that is sent from the binding device 79 is thrust by the abutting plate 61, thereby folding the sheet bundle in half with the folding roller pair 59, so as to be in the form of a folded booklet.

(Operations of Sheet Processing Device of First Embodiment)

The binding device 79 receives and arranges the sheets into a bundle at the saddle tray 60 in the order sent from the discharge roller pair 63. The arranged sheet bundle is bound in the middle by the stapler 62. After this, the abutting plate 61 that is an abutting member is moved by an abutting plate motor (not shown) and abuts the bound portion of the sheet bundle in the direction of the thickness of the sheet bundle, and presses the sheet bundle into the nip portion of the folding roller pair 59. The abutting plate 61 retreats after pushing the sheet bundle between the folding roller pair 59. The folding roller pair 59 is rotated by a motor (not shown), and while gripping and conveying the sheet bundle, folds it in half, and sends it through to the folded back portion flattening processing device 21. Lastly, the folded back portion flattening processing device 21 flattens down the folded back portion of the sheet bundle, and discharges the sheet bundle onto a discharge tray 16.

As described above, the sheet processing device 2 takes the sheets upon which an image is formed within the main device unit 3, forms a bundle thereof at the saddle tray 60, binds the bundle with the stapler 62, then folds this bundle in half into a booklet-like form with the folding device 58, and flattens down the folded back portion of the sheet bundle S into a booklet-like form by the folded back portion flattening processing device 21.

Folded Back Portion Flattening Processing Device (Configuration of Folded Back Portion Flattening Processing Device)

As illustrated in FIGS. 1 through 4, the folded back portion flattening processing device 21 presses and flattens the folded back portion (back cover) Sb, that is curved into a U-shape of the sheet bundle in a booklet-like form and sent from the folding device 58, with a pressing roller 7, so that the cross-sectional form of the folded back portion area is a somewhat square shape with essentially no bulging.

The folded back portion flattening processing device 21 includes a gripping device 14 (gripping unit) that has a gripping roller pair 4 and 5 as a conveying rotary member pair that grip the folded sheet bundle S, a pressing device 15 (pressing unit) having a pressing roller 7 that presses the folded back portion Sb of the sheet bundle S gripped by the gripping device 14.

The lower gripping roller 5 is a roller on the drive side, and is rotated by a rotational force of a roller drive motor 8 via a gear train 6 and a rotating shaft 9. The upper gripping roller 4 has a rotating shaft 12, and rotates with the lower gripping roller 5. The gripping roller pair 4 and 5 has a length longer than the width of the sheet bundle. The gripping device 14 includes the gripping roller pair 4 and 5 and the roller drive motor 8. On the downstream side of a nip portion N of the gripping roller pair 4 and 5, a back folded portion detecting sensor 10 is provided as a detecting unit for detecting the folded back portion Sb of the sheet bundle that protrudes from the nip portion N.

Alternative to the folded back portion detecting sensor 10, an arrangement may be made wherein the rotational force of the roller drive motor 8 is detected and the amount of protrusion of the folded back portion from the nip portion N of the gripping rollers 4 and 5 is detected. The roller drive motor 8 and the folded back portion detecting sensor 10 are connected to the processing device control unit 20.

(Operations of Folded Back Portion Flattening Processing Device)

Figure 2A:
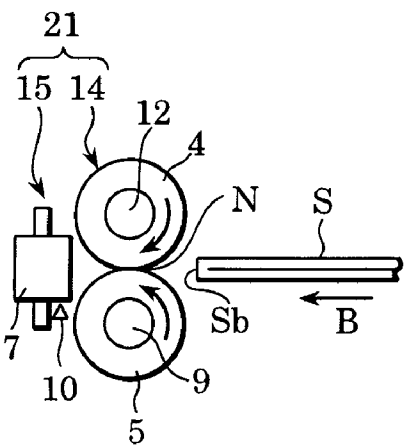
FIGS. 2A through 2F are front schematic views and action description diagrams of the folded back portion flattening processing device illustrated in FIG. 1.
Figure 2B:
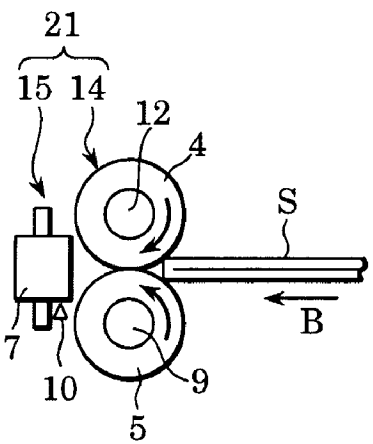
Figure 2C:
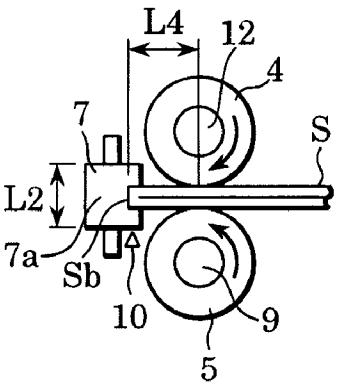

The conveying belt pair 13 conveys the sheet bundle in the direction of the arrow B, with the folded back portion Sb of the sheet bundle S in front. The processing device control unit 20 starts the roller drive motor 8 (FIG. 4 (S1)). The gripping roller pair 4 and 5 starts rotating (FIGS. 2A and 3A, (S2)). The gripping roller pair 4 and 5 grips and conveys the sheet bundle S when the folded back portion Sb of the sheet bundle arrives and enters the nip portion N (FIGS. 2B and 3B). When the folded back portion Sb protrudes from the nip portion N and is detected by the folded back portion detecting sensor 10 (FIGS. 2C and 3C (S3)), the processing device control unit 20 stops the roller drive motor 8 (S4).

The gripping roller pair 4 and 5 stops rotating while still gripping the sheet bundle (S5). At this time, the folded back portion Sb is protruding only by the predetermined length (L4) from the nip portion N of the gripping roller pair 4 and 5 in the position in which the portion Sb is being pressed by the pressing roller 7. On the downstream side of the nip portion N, a stopper can be provided that includes an abutting face in the direction perpendicular to the conveying direction of the sheet bundle wherein the folded back portion Sb is abutted in a predetermined position, and the angle of the conveying direction of the sheet bundle can be corrected. In the instance of abutting to a stopper, the gripping pressure of the gripping roller pair 4 and 5 needs to be reduced or eliminated so that correcting the position of the sheet bundle is facilitated.

Figure 2D:
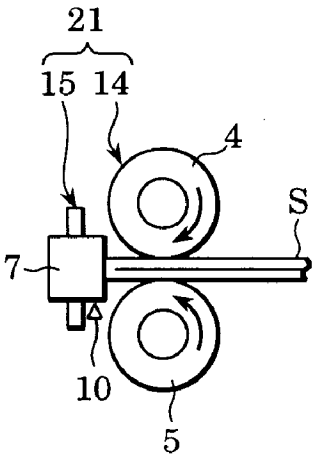
Figure 2E:
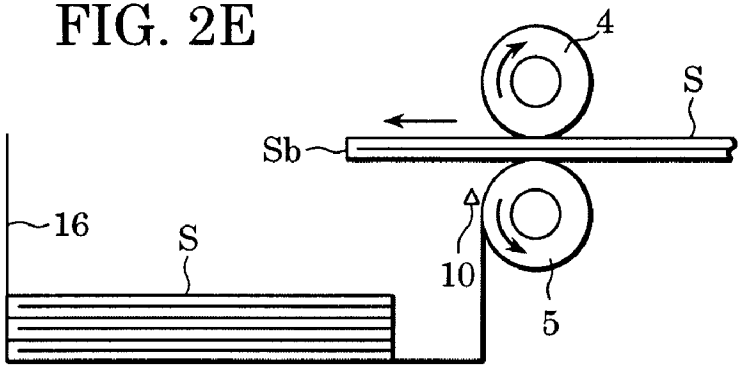
Figure 3D:
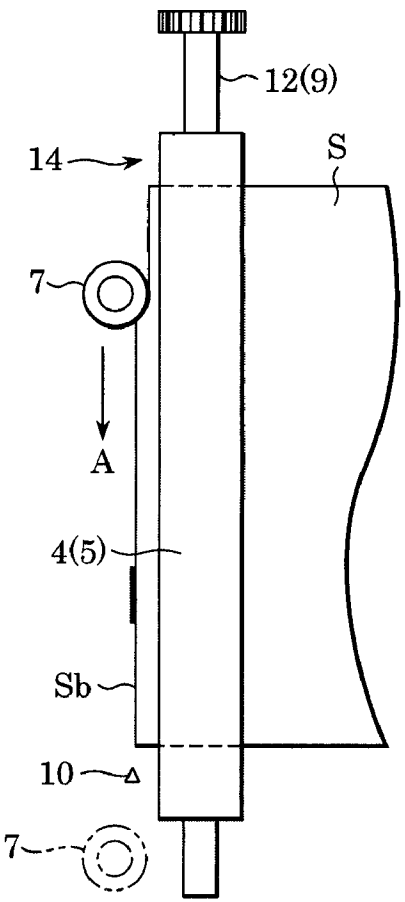
Figure 4:
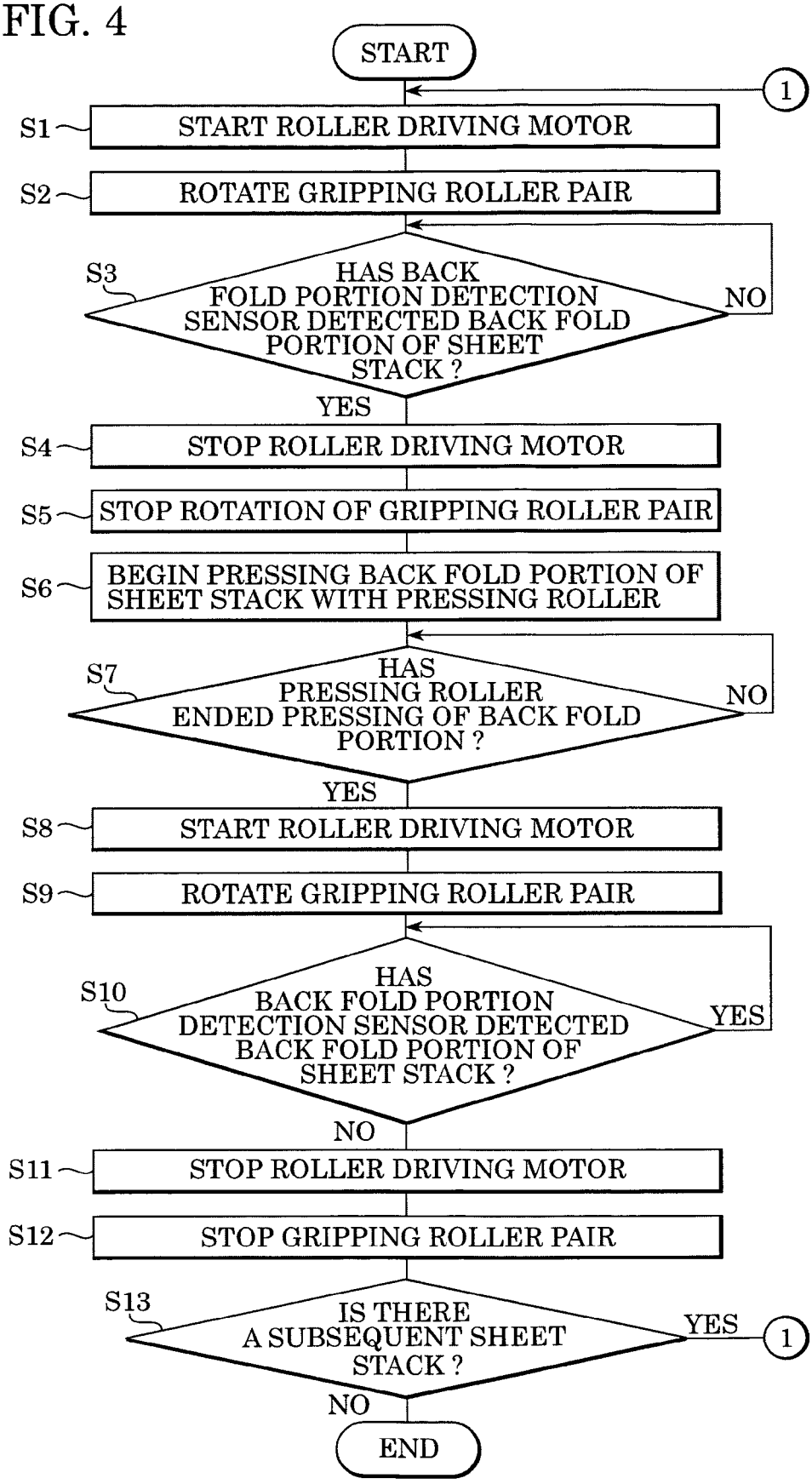
FIG. 4 is a flowchart for describing the action of the folded back portion flattening processing device illustrated in FIG. 1.

After this, the pressing roller 7 moves while rotating in the direction of arrow A (in the direction along the folded back portion Sb) while pressing the folded back portion Sb (FIGS. 2D and 3D (S6)). The folded back portion Sb of the sheet bundle is pressed by the pressing roller 7 while in the state of being gripped by the gripping roller pair 4 and 5. The cross-sectional form of the folded back portion area becomes a somewhat squared shape with essentially no bulging. The distance between the pressing face of the pressing roller 7 and the nip portion N of the gripping roller pair 4 and 5 at this time is set to be shorter than the protruding length (L4) of the folded back portion Sb, and is sufficient for flattening down the folded back portion Sb, and the appropriate pressure is placed so as not to cause damage to the folded back portion Sb.

Figure 2F:
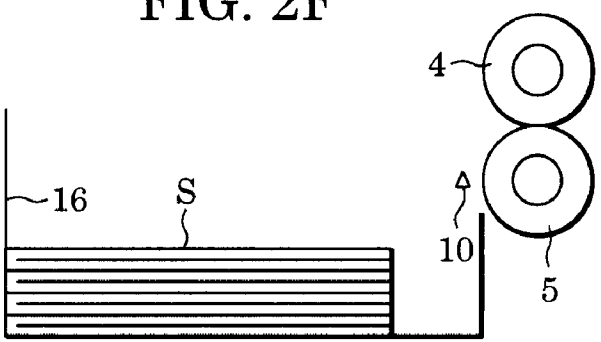

When the flattening processing of the folded back portion Sb is completed by the pressing roller 7 (S7), the processing device control unit 20 restarts the roller drive motor 8 (S8). The gripping roller pair 4 and 5 rotates and conveys the sheet bundle S (FIG. 2E (S9)). The sheet bundle S is discharged onto the discharge tray 16 (FIG. 2F). When the sheet bundle is sent out from the gripping roller pair 4 and 5, and the folded back portion Sb is no longer detected by the folded back detecting sensor 10 (S10), the processing device control unit 20 determines that the sheet bundle S has been discharged onto the discharge tray 16, and stops the roller drive motor 8 (S11). Thus, the gripping roller pair 4 and 5 also stops (S12).

After this, in the case that a subsequent sheet bundle exists (S13), the folded back portion flattening processing device 21 returns to S1, and flattens down the folded back portion of the subsequent sheet bundle. In the case of no subsequent sheet bundle, the folded back portion flattening processing device 21, the sheet processing device 2, and the photocopier 1 end their actions.

Now, the pressing roller 7 stops in the position illustrated by the dotted line in FIG. 3D after flattening down the folded back portion Sb of the sheet bundle S, but can flatten down the folded back portion Sb of the next sheet bundle while returning to the position illustrated by a solid line in FIG. 3A from the dotted line position. Alternatively, upon returning to the position illustrated with the solid line of FIG. 3A, the back folded portion Sb of the subsequent sheet bundle can be flattened down while moving again to the position illustrated by the dotted line in FIG. 3D.

With the above configuration, a conveying belt 13 is not necessarily required. A directional plate that supports the sheet bundle may be provided. In this case, the sheet bundle is directly handed from the folding roller pair 59 to the gripping roller pair 4 and 5.

Figure 5A:
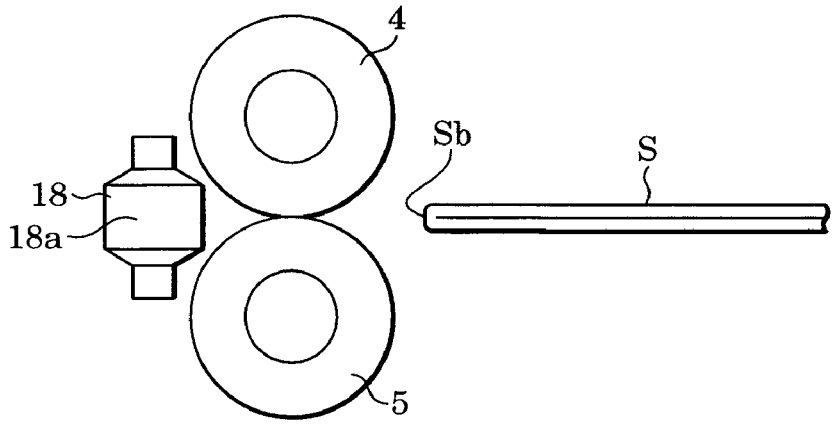
FIGS. 5A through 5C are front views of another example of the pressing roller in the folded back portion flattening processing device illustrated in FIG. 1.
Figure 5B:
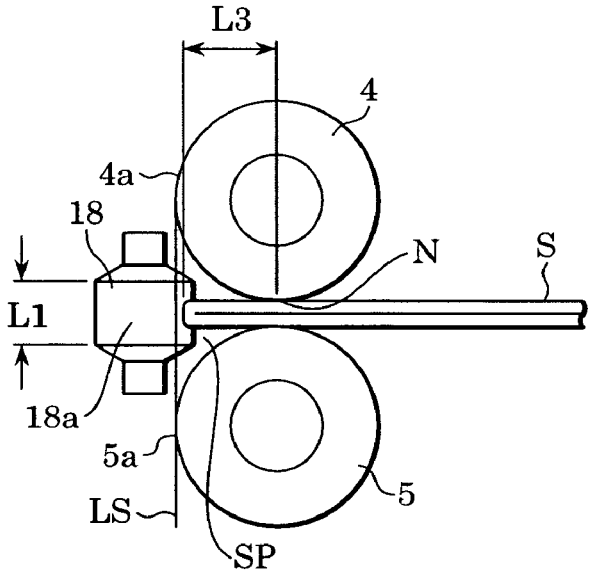
Figure 5C:
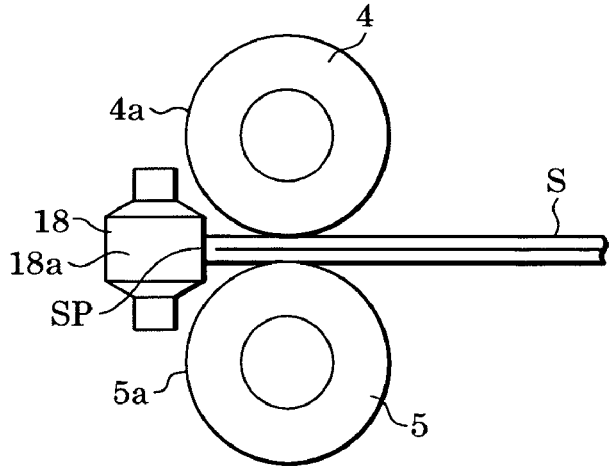

Now, FIGS. 5A through 5C illustrate a pressing roller 18 serving as a pressing unit that has a different configuration from the pressing roller 7 illustrated in FIGS. 2A through 2F. As illustrated in FIG. 5B, with the pressing roller 18, the length of a rotating face 18*a* (L1) of the pressing roller 18 that presses on the folded back portion Sb is of a length that can enter a region SP formed by the common tangent lines of the gripping roller pair 4 and 5 and the periphery faces 4*a* and 5*a*. In other words, the axial direction length of the pressing face of the pressing roller 18 that presses the folded back portion Sb is set to be shorter than the distance between the center of the gripping roller pair 4 and 5, and thus can enter in the region that is formed by the common tangent lines of the gripping roller pair 4 and 5 and the periphery faces 4*a* and 5*a*. On the other hand, the length L2 of a rotating face 7*a* of the pressing roller 7 (see FIGS. 2A through 2F) is set to a length that cannot enter the region that is formed by the common tangent lines of the gripping roller pair 4 and 5 and the periphery faces 4*a* and 5*a*. Therefore, the pressing roller 18 can approach the nip portion N of the gripping rollers 4 and 5 closer than the pressing roller 7, and the protruding length L3 of the sheet bundle of the pressing roller 18 can be made shorter than the protruding length L4 (see FIGS. 2A through 2F) of the sheet bundle of the pressing roller 7 (L3<L4). As a result, the pressing roller 18 of FIG. 5B allows for a shorter protruding length of the sheet bundle than the pressing roller 7 of FIG. 2C, and pressing the folded back portion results in less deformation such as the folded back portion escaping, and the folded back portion can be more easily flattened down.

The gripping roller pair 4 and 5 is formed with a circular cross-section. Alternatively, the gripping roller pairs 204 and 205, 304 and 305, 404 and 405, and 504 and 505 as illustrated in FIGS. 11A through 11F and FIGS. 14A through 16F to be described below can be formed as relief flat faces 204*b* and 205*b*, relief notches 304*c* and 305*c*, relief faces 404*d* and 405*d*, relief flat faces 504*b* and 505*b*, and relief faces 504*d* and 505*d*. Further, a conveying belt pair (rotary member pair) can be used in place of the gripping roller pair 4 and 5.

The pressing roller 7 or 18 that moves in the sheet width direction is used as a pressing unit to flatten down the folded back portion of the sheet bundle, but a circulating belt can be used that has a straight line portion greater than the sheet width wherein the folded back portion is pressed. In the case of using belts, in order to correspond to the pressing roller 18, the belt width should be made to the width that can enter the external periphery on the inner side of the common tangent lines of the gripper roller pair.

The folded back portion flattening processing device 21 of the above embodiment is configured to flatten down the folded back portion of the sheet bundle that is bound with the stapler 62. Alternatively, flattening down the folded back portion of sheet bundles that are not bound, or sheet bundles that are bound using perfect binding can be performed.

As described above, the gripping roller pair 4 and 5 in the sheet processing device 2 of the present embodiment performs conveying of the sheet bundle, gripping of the sheet bundle when the pressing roller 7 is flattening down the folded back portion, and conveying of the sheet bundle after the folded back flattening process. Therefore, the sheet processing device 2 of the present embodiment can use the gripping roller pair 4 and 5 for the function of gripping the sheet bundle and the function for conveying the sheet bundle. As such, the configuration can be made simpler, and the device can be made more compact so as to take up less space.

Further, the sheet processing device 2 of the present embodiment folds and conveys the sheet bundle with the folding roller pair 59, and then grips and conveys with the gripping roller pair 4 and 5, resulting in the folding action of the sheet bundle being performed twice. Therefore, the sheet processing device 2 of the present embodiment can improve the folding quality of the sheet bundle.

Further, with the sheet processing device 2 of the present embodiment, at the point in which the gripping roller pair 4 and 5 is gripping the sheet bundle, the back edge of that sheet bundle is extended from the folding roller pair 59, the subsequent sheet bundle can be folded with the folding device 28 during the folded back flattening processing, and productivity can be improved. That is to say, the photocopier 1 of the present invention has a sheet processing device 2 wherein the configuration is simple and compact, and therefore the device can be made more compact and take up less space.

Sheet Processing Device of Second Embodiment (Configuration of Sheet Processing Device of Second Embodiment)

As illustrated in FIGS. 6 through 9, the sheet processing device 102 of the second embodiment has a folded back face processing device 130 wherein the folding device 58 of the sheet processing device 2 of the first embodiment and the folded back portion flattening processing device 21 are integrated.

Figure 6:
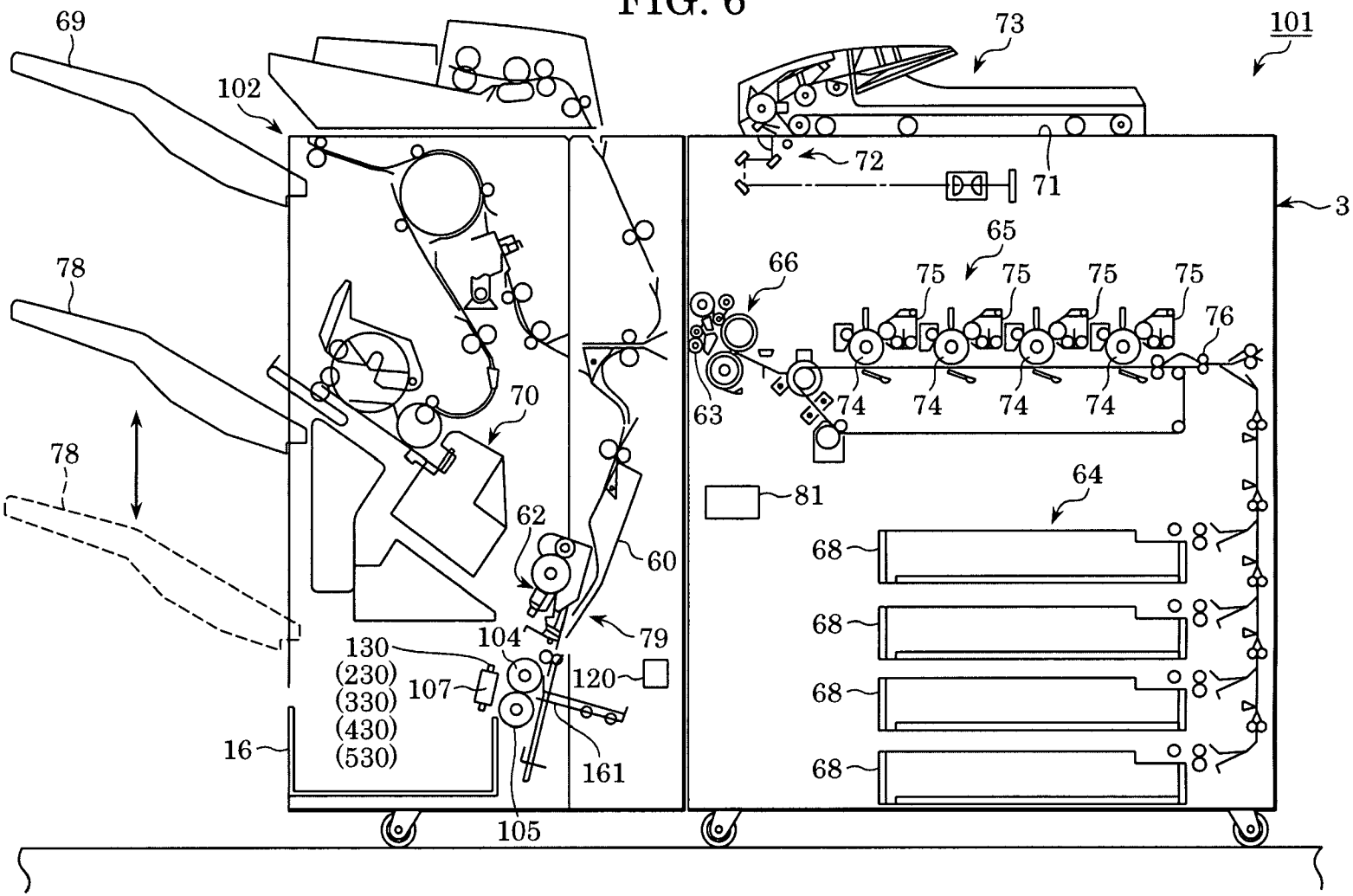
FIG. 6 is a schematic cross-sectional front view of a photocopier incorporating a sheet processing device according to a second embodiment, having the folded back face processing device according to the first embodiment relating of the present invention.

Now, with the sheet processing device 102 illustrated in FIG. 6, and the photocopier 101 including this sheet processing device 102 in the main device unit 3, components which are the same as those of the sheet processing device 2 of the first embodiment and the photocopier 1 having this sheet processing device 2 will be denoted by the same reference numerals and description thereof will be omitted. Further, the sheet processing device 102 of the second embodiment can have folded back face processing devices 230, 330, 430, or 530 of the second through fifth embodiments, in place of the folded back face processing device 130 of the first embodiment.

Folded Back Face Processing Device of First Embodiment (Configuration of Folded Back Face Processing Device of First Embodiment)

As illustrated in FIG. 7A through FIG. 8D, the folded back face processing device 130 of the present embodiment includes an abutting plate 161 that is an abutting member for abutting the bound portion of the sheet bundle that has been bound with the binding device 79, a gripping device 114 serving as a sheet gripping unit having a gripping roller pair 104 and 105 serving as a conveying rotary unit which receives the sheet bundles abutted by the abutting plate 161 in the nip portion N, a pressing device 115 serving as a pressing unit having a pressing roller 107 serving as a pressing unit that presses the folded back portion Sb of the sheet bundle S gripped by this gripping device 114, an abutting plate detecting sensor 111 that detects the tip of the abutting plate 161, and a folded back portion detecting sensor 10 serving as a detecting unit that detects the folded back portion Sb of the sheet bundle protruding from the nip portion N. The abutting plate detecting sensor 111 and the folded back portion detecting sensor 10 are connected to the processing device control unit 120.

Now, the abutting plate 161 is moved by the abutting plate motor (not shown), and the position can be detected based on the rotations of the abutting plate motor. In this case, the abutting plate detecting sensor 111 does not need to be provided.

The lower gripping roller 105 is a roller on the drive side, and is rotated by the gear train 6 and the rotating shaft 109 from the rotational force of the roller drive motor 8. The upper gripping roller 104 has a rotating shaft 112, and rotates in accordance with the rotations of the lower gripping roller 105. The gripping device 114 includes the gripping roller pair 104 and 105 and the roller drive motor 8.

(Operations of Sheet Processing Device of Second Embodiment and Folded Back Face Processing Device of First Embodiment)

The binding device 79 receives and arranges the sheets into a bundle in the saddle tray 60 in the order that they are sent from the discharge roller pair 63. The arranged sheet bundle is bound in the middle by the stapler 62.

Figure 7A:
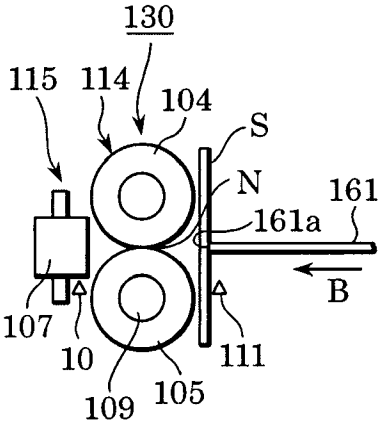
FIGS. 7A through 7F are front views and action description diagrams of the folded back face processing device according to the first embodiment illustrated in FIG. 6.
Figure 8A:
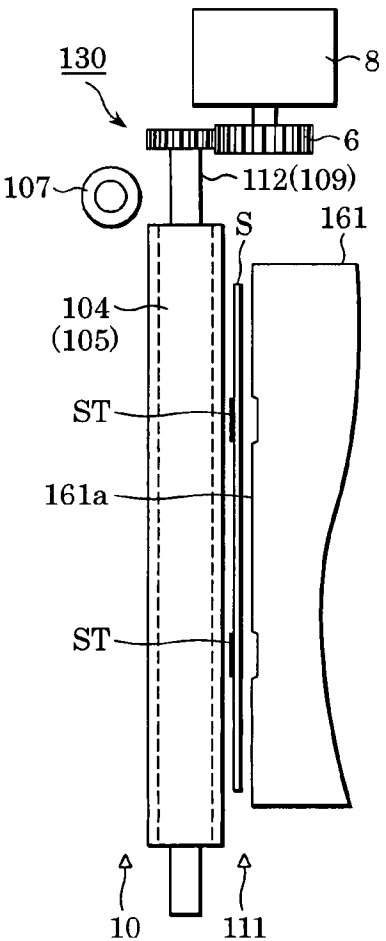
FIGS. 8A through 8D are plan view schematic diagrams and action description diagrams of the folded back face processing device illustrated in FIG. 6.

After this, the abutting plate 161 is moved by the abutting plate motor (not shown), and moves closer to the bound portion of the sheet bundle (FIGS. 7A and 8A). Upon the abutting plate detecting sensor 111 detecting the tip 161*a* of the abutting plate 161, the processing device control unit 120 starts the roller drive motor 8 (FIG. 9 (S101) (S102)). The gripping roller pair 104 and 105 starts to rotate (FIGS. 7A and 8A (S103)).

Now, in a case wherein the abutting plate detecting sensor 111 is not provided, and the position of the abutting plate 161 is detected by the rotations of the abutting motor (not shown) which moves the abutting plate 161, the roller drive motor 8 can be started with the ON signal of this abutting plate motor as a trigger.

Figure 7B:
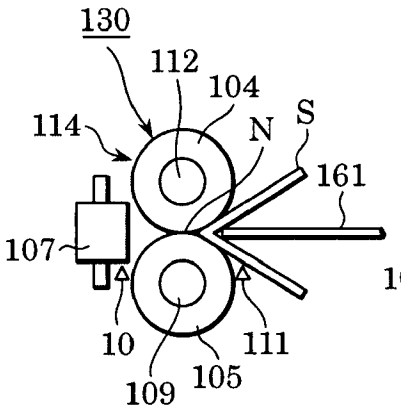
Figure 7C:
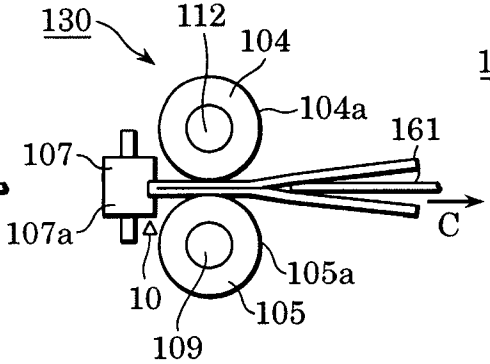
Figure 8B:
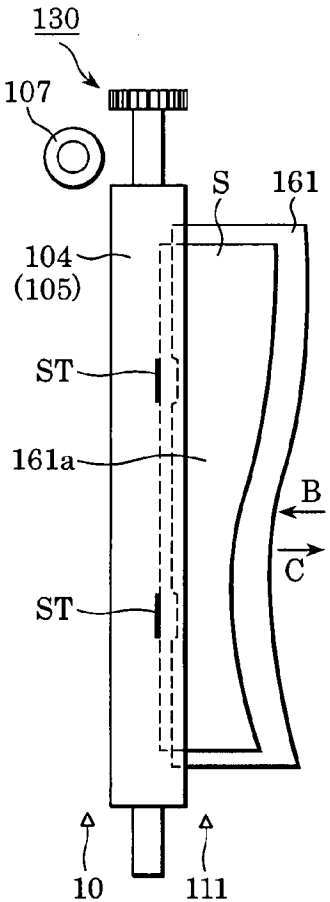
Figure 8C:
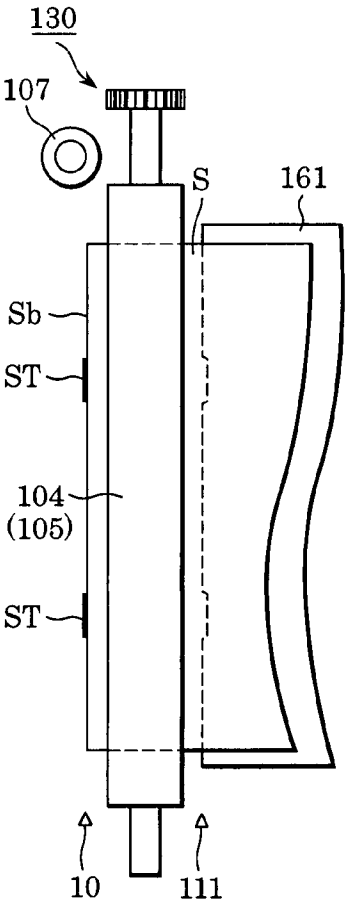

The abutting plate 161 presses the sheet bundle into the nip portion N of the gripping roller pair 104 and 105. The gripping roller pair 104 and 105 receives the sheet bundle pushed in with the nip portion N, and grips and conveys the sheet bundle S (FIGS. 7B and 8B). The abutting plate 161 that has pushed the sheet bundle into the nip portion N retreats in the direction of the arrow C (FIG. 8B). The gripping roller pair 104 and 105 conveys the sheet bundle while folding, so that the sheet bundle assumes a booklet-like form. When the folded back portion Sb protrudes from the nip portion N and is detected by the folded back portion detecting sensor 10 (FIGS. 7C and 8C (S104)), the processing device control unit 120 stops the roller drive motor 8 (S105).

The gripping roller pair 104 and 105 stops rotating while still gripping the sheet bundle (S106). At this time, the folded back portion Sb protrudes only by a predetermined length (0.7 mm to 1.5 mm for example; however, the present embodiment is not restricted to this range, and the range may vary according to the material and/or the thickness of the sheet) from the nip portion N of the gripping roller pair 104 and 105 in the position wherein it is pressed by the pressing roller 107.

Figure 7D:
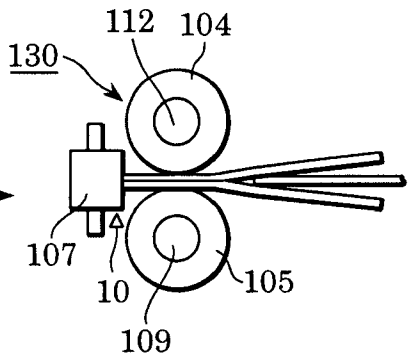
Figure 7E:
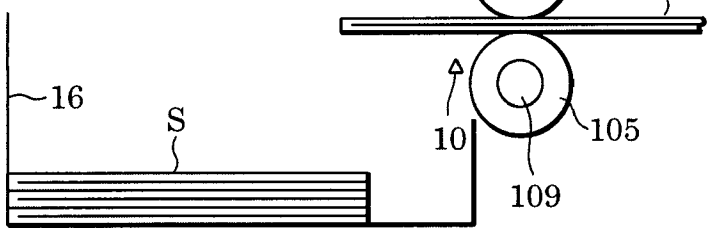
Figure 8D:
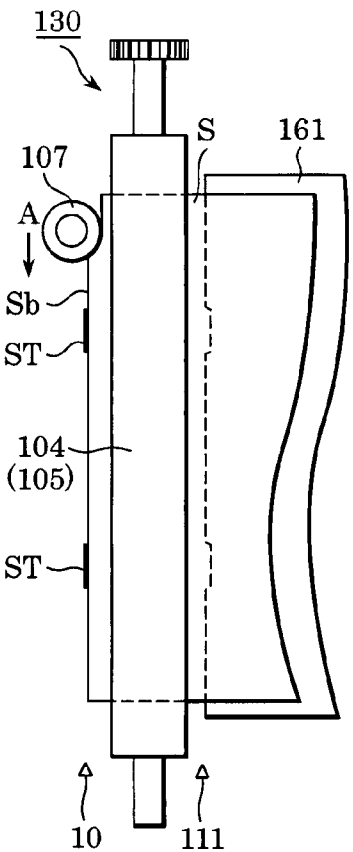
Figure 9:
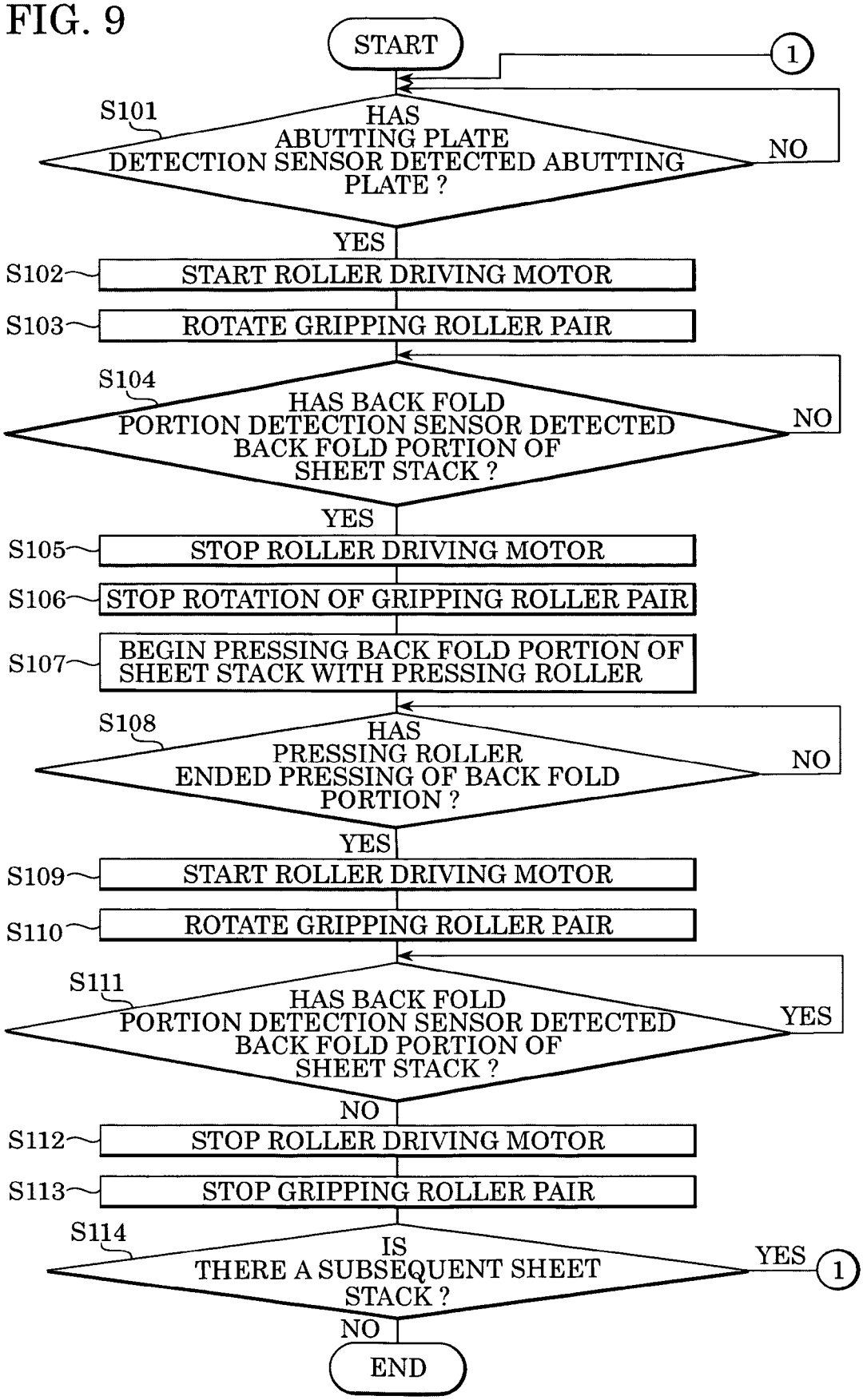
FIG. 9 is a flowchart for describing the action of the folded back face processing device illustrated in FIG. 6.

After this, the pressing roller 107 moves while rotating in the direction of arrow A (in the direction along the folded back portion Sb) while pressing the folded back portion Sb (FIGS. 7D and 8D (S107)). The folded back portion Sb of the sheet bundle is pressed by the pressing roller 107 while in the state of being gripped by the gripping roller pair 104 and 105. The cross-sectional form of the folded back portion area becomes a somewhat squared shape with essentially no bulging.

Figure 7F:
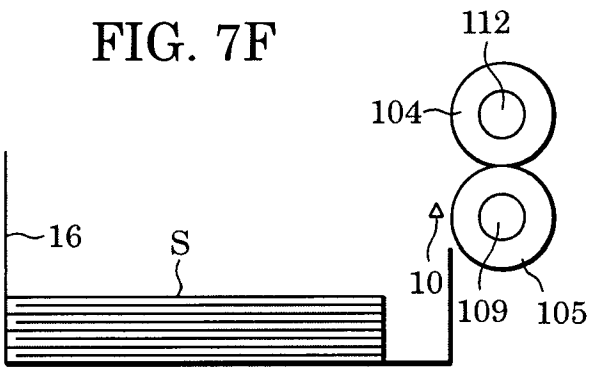

When the flattening processing of the folded back portion Sb is completed by the pressing roller 107 (S108), the processing device control unit 120 restarts the roller drive motor 8 (S109). The gripping roller pair 104 and 105 rotates and conveys the sheet bundle S (FIG. 7E (S110)). The sheet bundle S is discharged onto the discharge tray 16 (FIG. 7F). When the sheet bundle is sent out from the gripping roller pair 104 and 105, and the folded back portion Sb is no longer detected by the folded back detecting sensor 10 (S111), the processing device control unit 120 determines that the sheet bundle S has been discharged onto the discharge tray 16, and stops the roller drive motor 8 (S112). Thus, the gripping roller pair 104 and 105 also stops (S113).

After this, in the case that a subsequent sheet bundle exists (S114), the folded back face processing device 130 returns to S101, and flattens down the folded back portion of the subsequent sheet bundle. In the case of no subsequent sheet bundle, the folded back face processing device 130, the sheet processing device 102, and the photocopier 101 end their actions.

Now, if the length of the rotating face 107*a* of the pressing roller 107 that presses the folded back portion Sb is set to a length that can enter between the periphery faces 104*a* and 105*a* of the gripping roller pair 104 and 105, similar to the pressing roller 18 illustrated in FIGS. 5A through 5C, a similar result as that of the pressing roller 18 can be obtained.

As described above, the gripping roller pair 104 and 105 in the folded back face processing device 130 of the present embodiment performs the conveying of the sheet bundle, the folding action of the sheet bundle while conveying the sheet bundle, the gripping of the sheet bundle when the pressing roller 107 is flattening down the folded back portion, and the conveying of the sheet bundle after the folded back flattening process. Therefore, the sheet processing device 102 of the present embodiment that has the folded back face processing device 130 of the present embodiment can use the gripping roller pair 104 and 105 for the function of folding the sheet bundle and forming it into a booklet-like form, and the function of gripping the sheet bundle and the function for conveying the sheet bundle, and the configuration can be made simpler, the device can be more compact, and can take up less space. Thus, the photocopier 101 of the present invention has the sheet processing device 102 wherein the configuration is simple and is compact, therefore the device can be more compact, and can take up less space.

Figure 10:
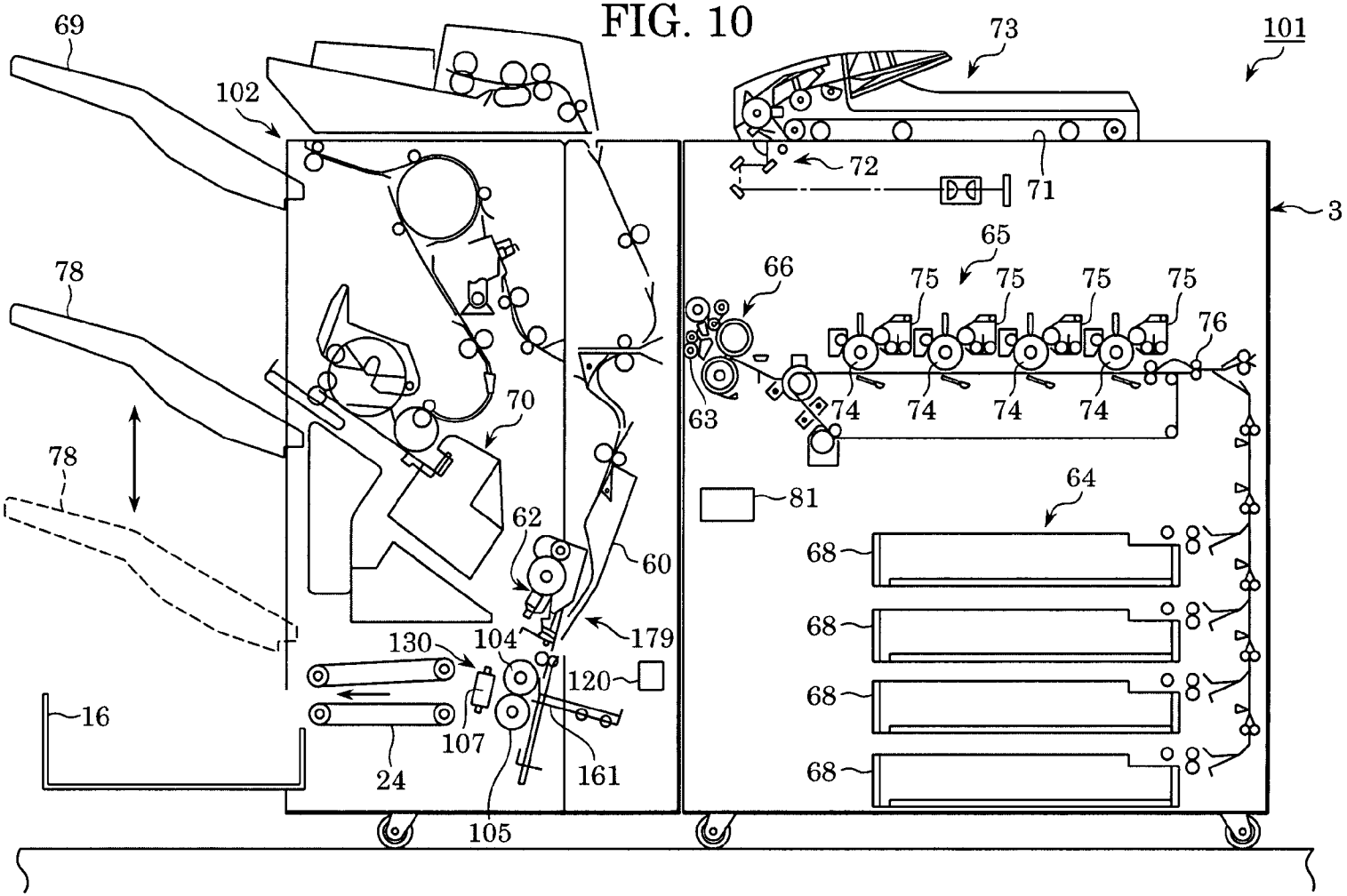
FIG. 10 is a front view schematic diagram of a photocopier in a case wherein the sheet processing device according to the first embodiment illustrated in FIG. 6 externally discharges the sheet bundle.

Now, as illustrated in FIG. 10, the sheet bundle that is folded and the back face processed by the sheet folded back face processing device 130 of the present embodiment can be discharged by the conveying belt pair 24 onto the discharge tray 16 that is provided externally. Further, in place of the discharge tray 16, a sheet cutter connected online to the main unit of the sheet processing device 102 can be provided. In this case, the sheet bundle can be taken out more easily.

Folded Back Face Processing Device of Second Embodiment (Configuration of Folded Back Face Processing Device of Second Embodiment)

As illustrated in FIG. 11A through FIG. 13, the folded back face processing device 230 of the present embodiment differs from the folded back face processing device 130 of the first embodiment in that the gripping rollers 204 and 205 a D-shape cross-section, and in that a sensor flag 221 (the shaded area of the diagram) that detects the rotation position of this gripping roller pair 204 and 205 and a rotating position sensor 222 that detects the rotation position of the sensor flag 221 are provided.

Now, the portions of the folded back face processing device 230 according to the present embodiment that differ from the folded back face processing device 130 of the first embodiment will be described, and portions which are the same will be denoted with the same reference numerals and description thereof will be omitted.

Figure 11A:
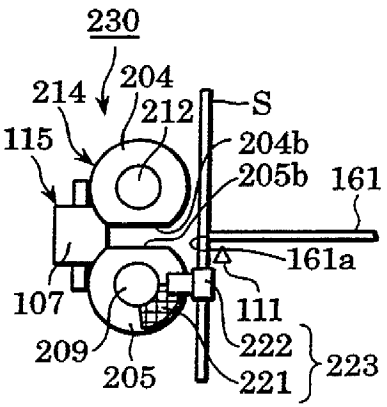
FIGS. 11A through 11F are front view schematic diagrams and action description diagrams of the folded back face processing device according to the second embodiment.
Figure 11B:
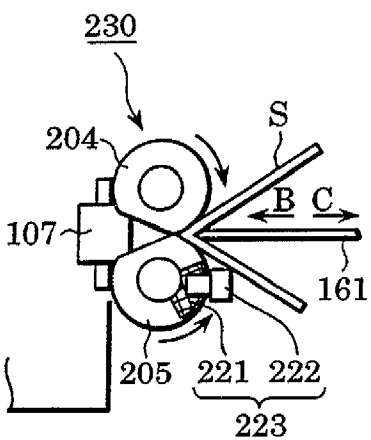
Figure 11C:
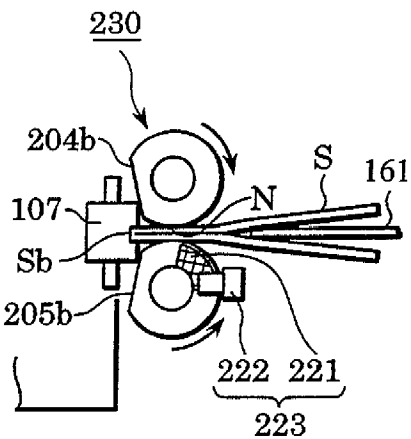
Figure 11D:
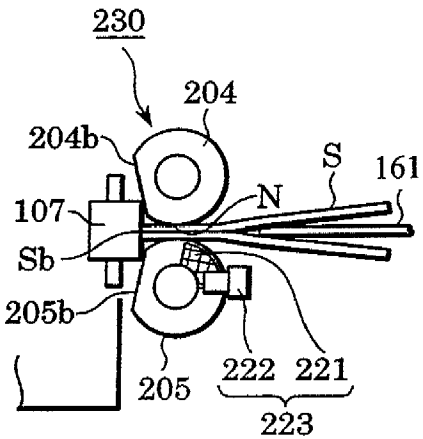
Figure 11E:
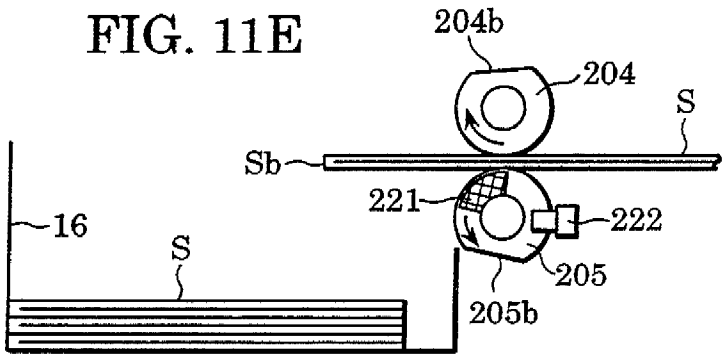
Figure 11F:
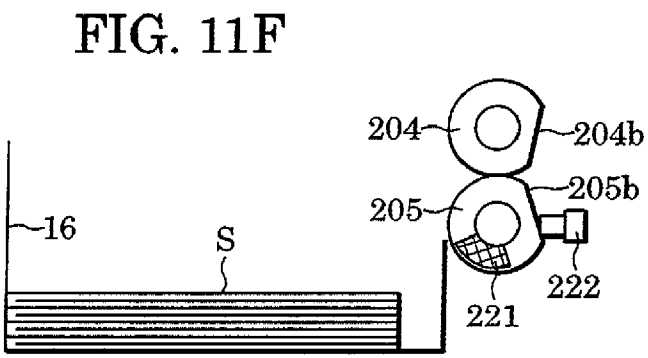

As illustrated in FIG. 11C, flat faces 204*b* and 205*b* of the gripping roller pair 204 and 205 that serve as a conveying rotary member pair making up the gripping device 214 which is a gripping unit are flat faces that are formed along the thrust direction of the gripping roller pair 204 and 205, and upon the gripping roller pair 204 and 205 projecting the folded back portion Sb from the nip portion N in the downstream side in the direction that the sheet bundle is conveyed and the sheet bundle conveying is temporarily stopped, the flat faces are formed at a position facing the pressing roller 107. The gripping roller pair 204 and 205 synchronically rotates, and as illustrated in FIG. 11D, the flat faces 204*b* and 205*b* face the pressing roller 107. Therefore, the rotating shafts 212 and 209 of the gripping roller pair 204 and 205 are provided with mutually meshing gears (not shown).

The sensor flag 221 is provided integrally on the rotating shaft 209 of the lower gripping roller 205, and is formed in a fan shape. The rotating position sensor 222 is fixed in a position that can detect the rotating sensor flag 221. The sensor flag 221 and the rotating position sensor 222 make up a detecting device 223 serving as a detecting unit for detecting whether the folded back portion Sb is protruding from the nip portion N in the position that is pressed by the pressing roller 107. The abutting plate detecting sensor 111 and the rotating position sensor 222 are connected to the processing device control unit 120.

(Operations of Folded Back Face Processing Device of Second Embodiment)

Figures 12A, 12B, 12C, 12D:
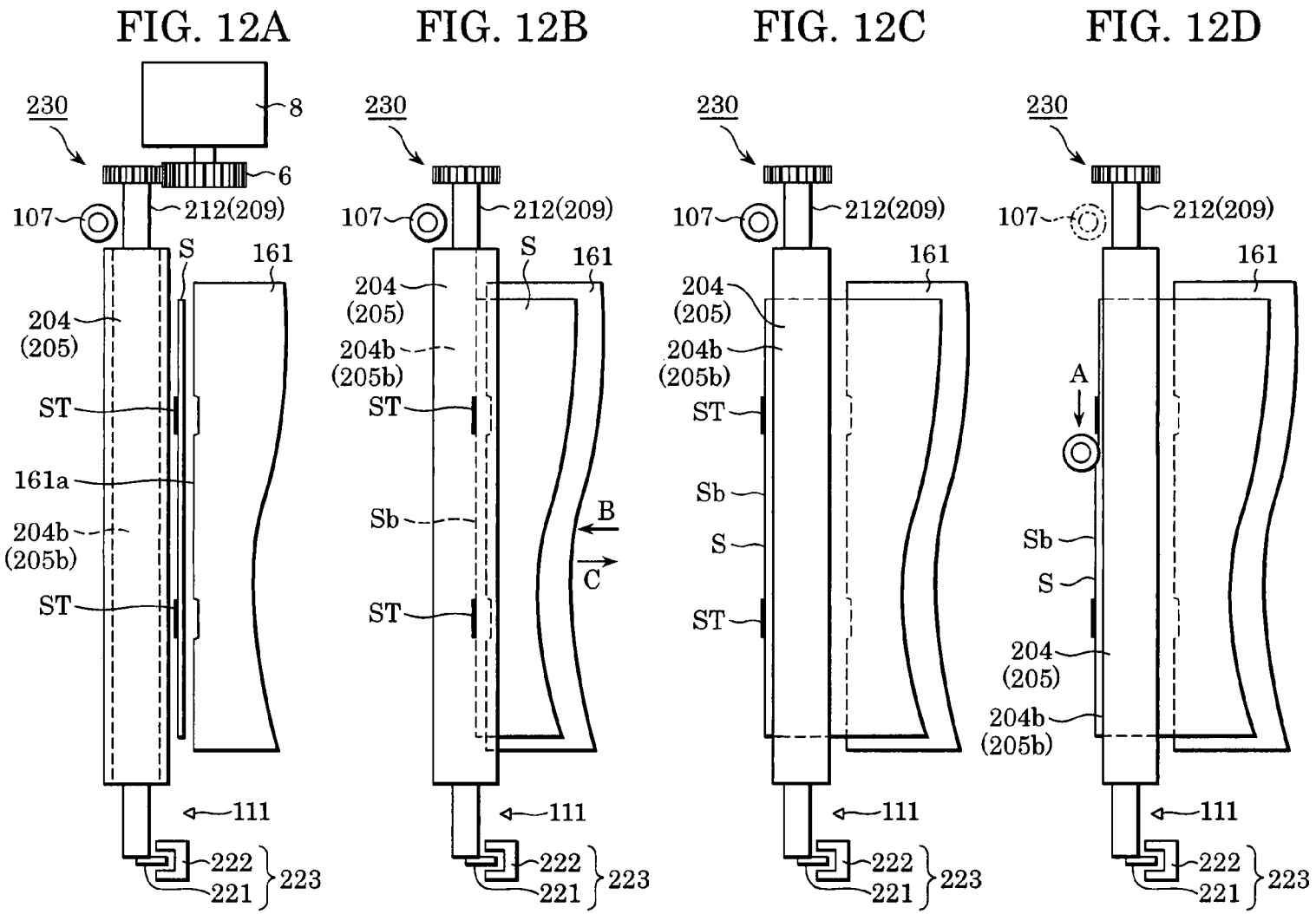
FIGS. 12A through 12D are plan view schematic diagrams and action description diagrams of the folded back face processing device according to the second embodiment as illustrated in FIGS. 11A through 11F.
Figure 13:
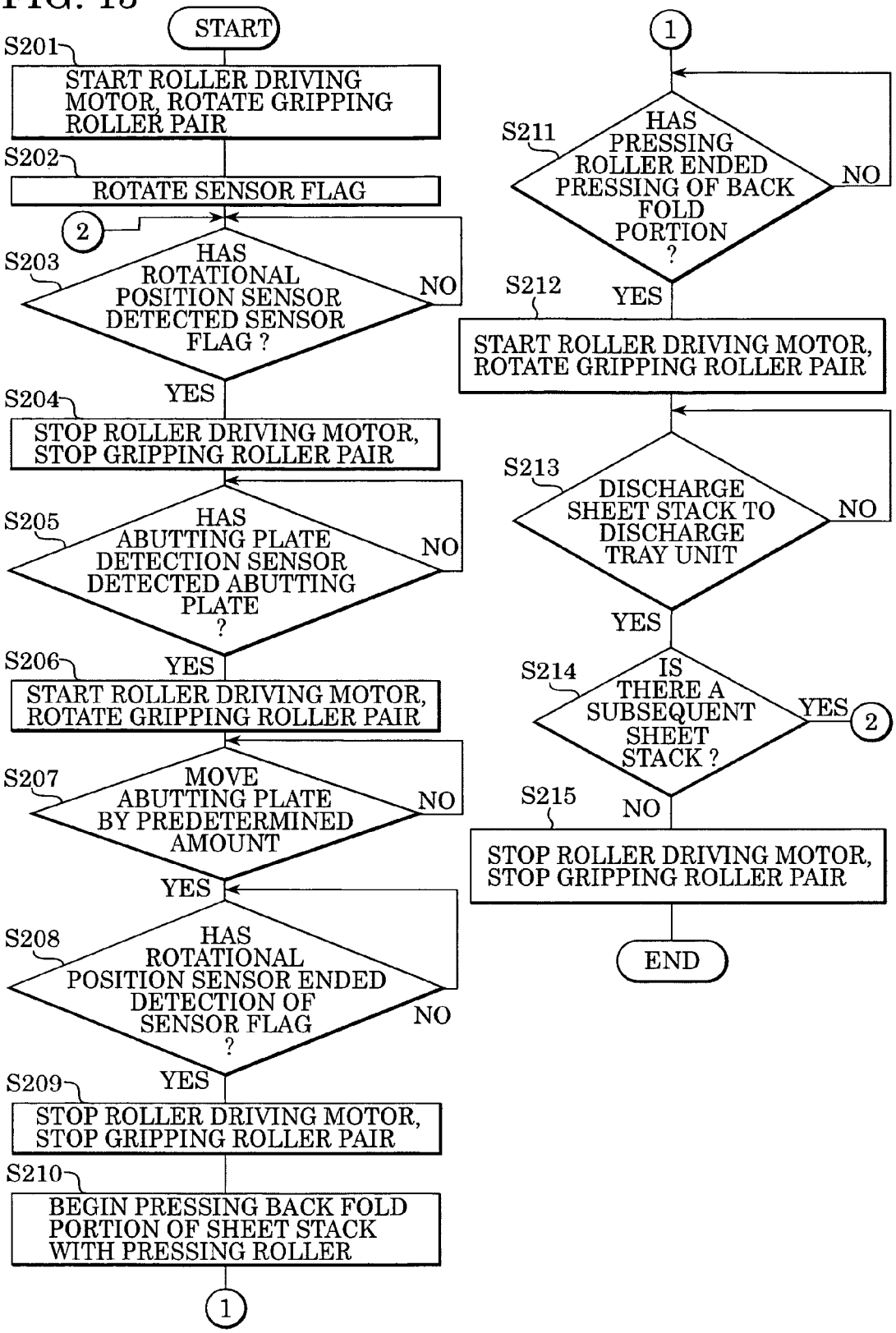
FIG. 13 is a flowchart for describing the action of the folded back face processing device according to the second embodiment as illustrated in FIGS. 11A through 11F.

The processing device control unit 120 starts the roller drive motor 8, and rotates the gripping roller pair 204 and 205 (FIG. 13 (S201)). The sensor flag 221 that is integral with the shaft 209 of the gripping roller 205 also rotates (S202). When the rotation position sensor 222 detects the sensor flag 221 (S203), the processing device control unit 120 stops the roller drive motor 8, and stops the gripping roller pair 204 and 205 (S204). As illustrated in FIG. 12A and FIG. 11A, the gripping roller pair 204 and 205 is in a standby state wherein the flat faces 204*b* and 205*b* are parallel to one another, and waits for the sheet bundle to be sent through. This position is the home position of the gripping roller pair 204 and 205.

The bound sheet bundle S is sent through from the upstream direction, and the portion bound with a stapler faces the tip of the abutting plate 161. The abutting plate 161 nears the gripping roller pair 204 and 205. When the abutting plate detecting sensor 111 detects the tip 161*a* of the abutting plate 161 (S205), the processing device control unit 120 starts the roller drive motor 8 (S206). The gripping roller pair 204 and 205 starts to rotate (S206).

Alternatively, the position of the abutting plate 161 can be detected by the rotations of the abutting motor (not shown) which moves the abutting plate 161, without the abutting plate detecting sensor 111 being provided. In this case, the roller drive motor 8 can be started with the ON signal of this abutting plate motor as a trigger.

At approximately the same time that the gripping roller pair 204 and 205 rotates and the nip portion N is formed, the abutting plate 161 presses the sheet bundle into this nip portion N (FIGS. 12B and 13B (S207)). The gripping roller pair 204 and 205 receives the sheet bundle pushed in with the nip portion N, and grips and conveys the sheet bundle S (FIGS. 11B and 12B). The abutting plate 161 that has pushed the sheet bundle into the nip portion N retreats in the direction of the arrow C (FIGS. 11B and 12B). The gripping roller pair 204 and 205 conveys while folding the sheet bundle, and accordingly, the sheet bundle assumes a booklet-like form.

Upon the rotating position sensor 222 detecting the sensor flag 221 (S208), the processing device control unit 120 stops the roller drive motor 8, and stops the gripping roller pair 204 and 205 (S209). The gripping roller pair 104 and 105 stops rotating while still gripping the sheet bundle. At this time, the folded back portion Sb protrudes only by a predetermined length from the nip portion N of the gripping roller pair 204 and 205 at the position of being pressed by the pressing roller 107 (FIGS. 11C and 12C). Further, the flat faces 204*b* and 205*b* are in the position that allows the pressing roller 107 to pass.

After this, the pressing roller 107 moves while rotating in the direction of arrow A (in the direction along the folded back portion Sb) while pressing the folded back portion Sb (FIGS. 11D and 12D (S210)). The folded back portion Sb of the sheet bundle is pressed by the pressing roller 107 while in the state of being gripped by the gripping roller pair 204 and 205. The cross-sectional form of the folded back portion area becomes a somewhat squared shape with essentially no bulging.

When the flattening processing of the folded back portion Sb is completed by the pressing roller 107 (S211), the processing device control unit 120 restarts the roller drive motor 8 (S212). The gripping roller pair 204 and 205 rotates and conveys the sheet bundle S (FIG. 11E (S212)). The sheet bundle S is discharged onto the discharge tray 16 (FIG. 11F (S213)).

After this, in the case that a subsequent sheet bundle exists (S214), the folded back face processing device 230 returns to S203, and flattens down the folded back portion of the subsequent sheet bundle. In the case of no subsequent sheet bundle, the folded back face processing device 230, the sheet processing device 102, and the photocopier 101 end their actions. The roller driving motor and the gripping roller pair 204 and 205 are stopped (S215).

The above described folded back face processing device 230 of the present embodiment has the flat faces 204*a* and 205*a* of the gripping roller pair 204 and 205 in the position that corresponds to the pressing roller 107, and since the pressing roller 107 is placed near the nip portion N, the protruding length of the sheet bundle from the nip portion N can be reduced. Therefore, the sheet processing device that has the folded back face processing device 230 of the present embodiment can have similar results as the folded back face processing device 130 of the first embodiment. Additionally, even when the pressing roller 107 flattens down the folded back portion, deformation such as the folded back portion escaping occurs less, the folded back portion can be more easily flattened down, and the quality of the folded back portion can be improved.

Folded Back Face Processing Device of Third Embodiment (Configuration of Folded Back Face Processing Device of Third Embodiment)

As illustrated in FIGS. 14A through 14F, the folded back face processing device 330 of the present embodiment differs from the configuration of the folded back face processing device 130 and 230 of the first and second embodiments in that notches 304*c* and 305*c* are formed so that the gripping roller pair 304 and 305 is capable of receiving the pressing roller 107. The notches 304*c* and 305*c* are formed with a cross-sectional recess form along the direction of thrust of the gripping roller pair 304 and 305.

Now, with the folded back face processing device 330 of the present embodiment as well, the sensor flag that determines the relative position of the notches 304*c* and 305*c* and the folded back portion Sb of the sheet bundle S, and the rotating position sensor by which the rotating position of this sensor flag is detected, are not illustrated in the diagram, but are similar to that of the folded back face processing device 230 of the second embodiment.

Further, the portions of the folded back face processing device 330 of the present embodiment that differ from the folded back face processing device 130 of the first embodiment will be described, and portions which are the same will be denoted with the same reference numerals and description thereof will be omitted.

(Operations of Folded Back Face Processing Device of Third Embodiment)

Figure 14A:
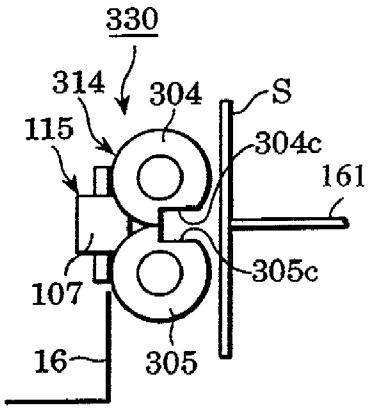
FIGS. 14A through 14F are front view schematic diagrams and action description diagrams of the folded back face processing device according to a third embodiment.

The gripping roller pair 304 and 305, serving as a conveying rotary pair making up the gripping device 314 serving as a gripping unit, is rotated by the roller drive motor, to a standby state wherein the notches 304*c* and 305*c* are parallel to one another, and waits for the sheet bundle to be sent through (FIG. 14A). This position is the home position of the gripping roller pair 304 and 305.

Figure 14B:
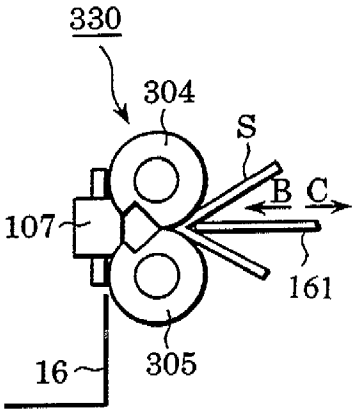

The bound sheet bundle S is sent through from the upstream direction, and the portion bound with a stapler faces the tip of the abutting plate 161. The gripping roller pair 304 and 305 begins rotating. At approximately the same time that the gripping roller pair 304 and 305 rotates and the nip portion N is formed, the abutting plate 161 pushes the sheet bundle into this nip portion N (FIG. 14B). The gripping roller pair 304 and 305 receives the sheet bundle pushed in at the nip portion N, and grips and conveys the sheet bundle S. The abutting plate 161 that has pushed the sheet bundle into the nip portion N retreats in the direction of the arrow C. The gripping roller pair 304 and 305 conveys while folding the sheet bundle, such that the sheet bundle assumes a booklet-like form.

Figure 14C:
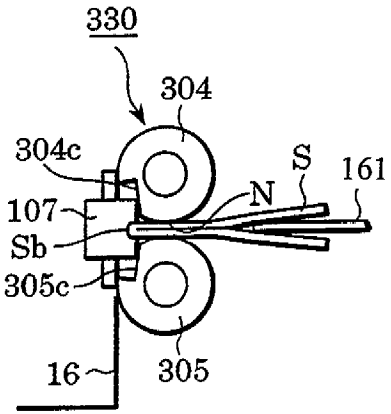

When the folded back portion Sb protrudes only by a predetermined length from the nip portion N of the gripping roller pair 304 and 305 to the position to be pressed by the pressing roller 107, the gripping roller pair 304 and 305 stops rotating (FIG. 14C). At this time, the notches 304*c* and 305*c* are in a position capable of receiving the pressing roller 107.

Figure 14D:
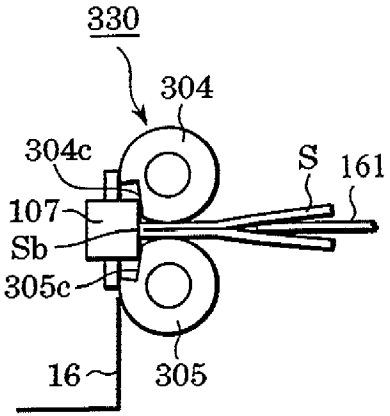

After this, the pressing roller 107 rotates and moves along the folded back portion Sb, and while pressing the folded back portion Sb within the notches 304*c* and 305*c* (FIG. 14D). The folded back portion Sb of the sheet bundle is pressed by the pressing roller 107 while in the state of being gripped by the gripping roller pair 304 and 305. The cross-sectional form of the folded back portion area is a somewhat squared shape with essentially no bulging.

Figure 14E:
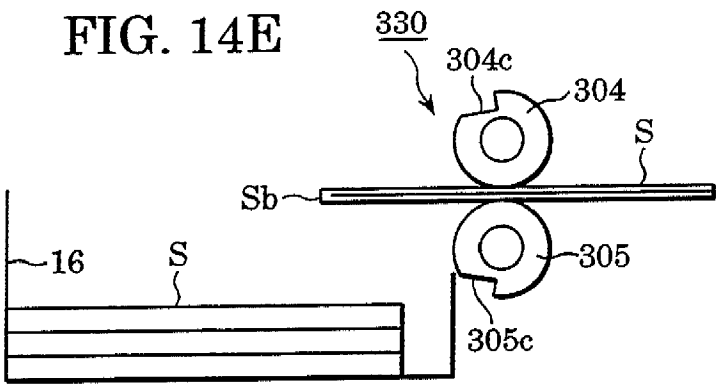
Figure 14F:
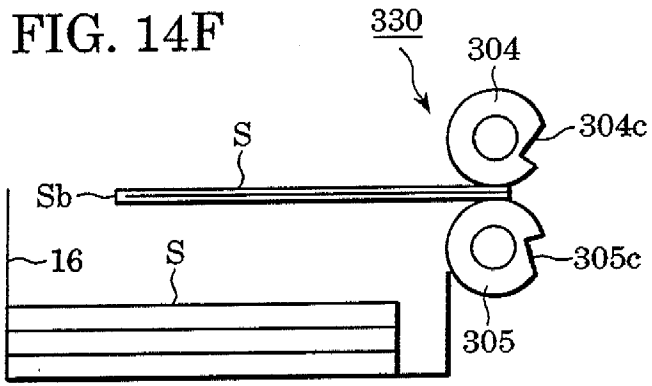

When the flattening processing of the folded back portion Sb by the pressing roller 107 ends, the gripping roller pair 304 and 305 rotates and conveys the sheet bundle S (FIGS. 14E and 14F). The sheet bundle S is discharged to the discharge tray 16.

After this, in the case that a subsequent sheet bundle exists, the gripping roller pair 304 and 305 returns to the state of FIG. 14A. In the case of no subsequent sheet bundle, the folded back face processing device 330, the sheet processing device 102, and the photocopier 101 end their actions.

As illustrated in FIGS. 14A through 14F, the above described folded back face processing device 330 of the present embodiment forms the notches 304*c* and 305*c* of the gripping roller pair 304 and 305 in the position that is capable of receiving the pressing roller 107, and because the pressing roller is placed near the nip portion N, the protruding length of the sheet bundle from the nip portion N can be made short. Therefore, the sheet processing device that has the folded back face processing device 330 of the present embodiment can have similar results as the folded back face processing device 130 of the first embodiment, and additionally even when the pressing roller 107 flattens down the folded back portion, deformation such as the folded back portion escaping occurs less, the folded back portion can be more easily flattened down, and the quality of the folded back portion can be improved.

Further, the notches 304*c* and 305*c* are sizes such that the pressing roller 107 can be received, and therefore the gripping roller pair 304 and 305 can increase the amount of sheet bundle conveying when discharging the sheet bundles to the discharge tray 16, after the folded back portion Sb flattening is processed.

Thus, the sheet processing device that has the folded back face processing device 330 of the present embodiment does not enlarge the diameter of the gripping roller pair 304 and 305, and can accurately discharge even a large size sheet bundle onto the discharge tray 16.

Now, a flat face to be described below can be formed onto the gripping roller pair 504 and 505 of the folded back face processing device 330 of the present embodiment. In this case, the protruding length of the folded back portion is shortened and the sheet is gripped by the flat faces. Therefore, even when the folded back portion is pressed with the pressing roller 107, deformation such as the folded back portion escaping occurs far less, the folded back portion can be more easily flattened down, and the quality of the folded back portion can be improved.

Folded Back Face Processing Device of Fourth Embodiment (Configuration of Folded Back Face Processing Device of Fourth Embodiment)

As illustrated in FIGS. 15A through 15F, the folded back face processing device 430 of the present embodiment differs from the configuration of the folded back face processing devices 130, 230, and 330 of the first, second, and third embodiments in that the gripping roller pair 404 and 405 is formed with a cross-sectional D-shape and the sheet bundle is gripped with the flat faces 404*d* and 405*d*.

Now, the portions of the folded back face processing device 430 of the present embodiment that differ from the folded back face processing device 130 of the first embodiment will be described, and the similar portions will use the same reference numerals, and the description thereof will be abbreviated.

The flat faces 404*d* and 405*d* are formed along the direction of thrust of the gripping roller pair 404 and 405, and are formed in the position to grip the sheet bundle when the gripping roller pair 404 and 405 protrudes the folded back portion to the downstream side and temporarily stops the conveying of the sheet bundle.

Further, with the folded back face processing device 430 of the present embodiment also, the sensor flag that determines the relative position of the flat faces 404*d* and 405*d* and the folded back portion Sb of the sheet bundle S, and the rotating position sensor by which the rotating position of this sensor flag is detected are not illustrated in the diagram, but are similar to that of the folded back face processing device 230 of the second embodiment. However, the relative position relationship between the flat face 405*b* and the sensor flag differs from the relative position relationship between the flat face 205*d* according to the second embodiment and the sensor flag thereof.

Further, the pressing roller 418 serving as a pressing unit of the pressing device 415 which is a pressing unit has the length (L1) of the rotating face 418*a* that presses the folded back portion Sb set to a length to allow entering the periphery faces 404*a* and 405*a* of the gripping roller pair 404 and 405, as with the pressing roller 18 illustrated in FIGS. 5A through 5C. Now, the pressing roller 418 does not necessarily need to be of a length enabling entering between the periphery 404*a* and 405*a* of the gripping roller pair 404 and 405 as with the pressing roller 7 illustrated in FIG. 2C.

(Operations of Folded Back Face Processing Device of Fourth Embodiment)

Figure 15A:
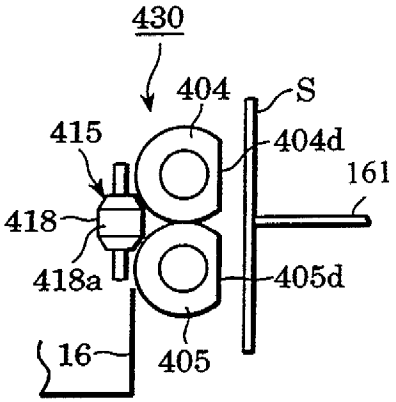
FIGS. 15A through 15F are front view schematic diagrams and action description diagrams of the folded back face processing device according to a fourth embodiment.

The gripping roller pair 404 and 405, serving as a conveying rotary pair making up the gripping device 414 which is a gripping unit, is rotated by the roller drive motor to position the flat faces 404*d* and 405*d* perpendicular to the abutting plate 161, and waits for the sheet bundle to be sent through (FIG. 15A). This position is the home position of the gripping roller pair 404 and 405.

Figure 15B:
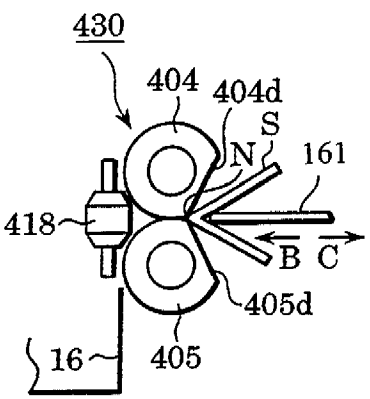

The bound sheet bundle S is sent through from the upstream direction, and the portion bound with a stapler faces the tip of the abutting plate 161. The gripping roller pair 404 and 405 begins rotating. At approximately the same time that the gripping roller pair 404 and 405 rotates and the nip portion N is formed, the abutting plate 161 pushes the sheet bundle into this nip portion N (FIG. 15B). The abutting plate 161 that has pushed the sheet bundle into the nip portion N retreats in the direction of the arrow C. The gripping roller pair 404 and 405 rotates and receives the sheet bundle pushed in at the nip portion N, and grips and conveys the sheet bundle S.

Figure 15C:
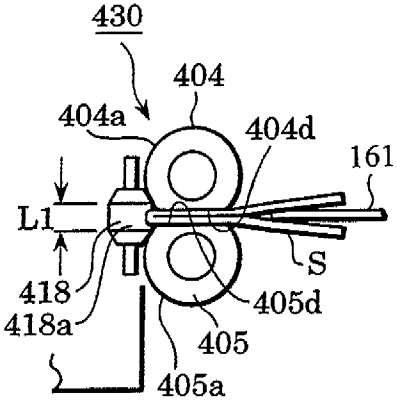

At the point when the flat faces 404*d* and 405*d* are facing one another and have become parallel, the gripping roller pair 404 and 405 stops rotating while still gripping the sheet bundle with the flat faces 404*d* and 405*d* (FIG. 15C). At this time, the sheet bundle is in the state of being gripped by the flat faces 404*d* and 405*d* and folded. Further, the folded back portion Sb protrudes from the gripping roller pair 404 and 405 and in the position to be pressed by the pressing roller 418.

Figure 15D:
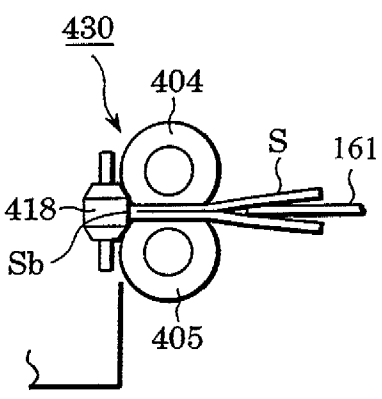

After this, the pressing roller 418 rotates and moves along the folded back portion Sb, while pressing the folded back portion Sb (FIG. 15D). The folded back portion Sb of the sheet bundle is pressed by the pressing roller 418 while in the state of being gripped by the gripping roller pair 404 and 405. The cross-sectional form of the folded back portion area is a somewhat squared shape with essentially no bulging.

Figure 15E:
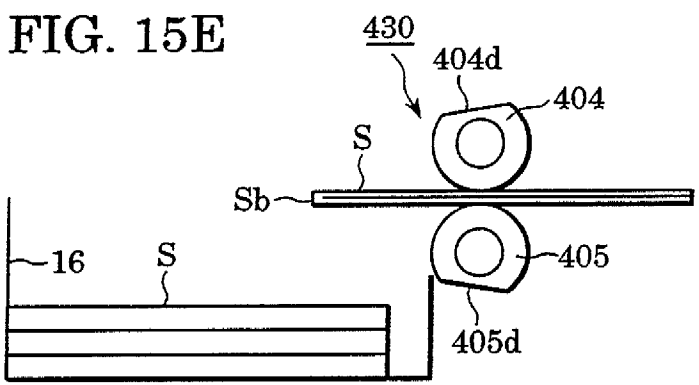
Figure 15F:
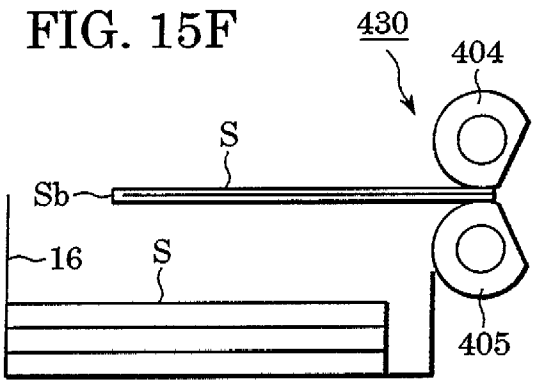

When the flattening processing of the folded back portion Sb by the pressing roller 418 ends, the gripping roller pair 404 and 405 rotates and conveys the sheet bundle S (FIGS. 15E and 15F). The sheet bundle S is discharged to the discharge tray 16.

After this, in the case that a subsequent sheet bundle exists, the pressing roller pair 404 and 405 returns to the state of FIG. 14A. In the case of no subsequent sheet bundle, the folded back face processing device 430, the sheet processing device 102, and the photocopier 101 end their actions.

As illustrated in FIG. 15C, the above described folded back face processing device 430 of the present embodiment is such that the sheet bundle is gripped by the flat faces 404*d* and 405*d* of the gripping roller pair 404 and 405. Therefore, the sheet processing device that has the folded back face processing device 430 of the present embodiment achieves the same advantages as those of the folded back face processing device 130 of the first embodiment. Conventionally, a greater gripping force has been necessary when gripping a sheet bundle with a large number of sheets. However, the gripping force can be lessened and the equipment can be made more compact with the present embodiment. Further, the folded back portion can be gripped closer, and a folded back portion with a flat form of high quality can be made easily.

Additionally, the risk of the sheet bundle being pressed by the pressing roller 418 and pushed into the gripping roller pair 404 and 405 is reduced, and therefore, a folded back portion with a flat form of even higher quality can be made more easily.

Further, as with the pressing roller 18 illustrated in FIGS. 5A through 5C, the pressing roller 418 is set to a length that can enter between the periphery faces 404*a* and 405*a* of the gripping roller pair 404 and 405, and therefore, the pressing roller 418 can be brought that much closer to the nip portion, and the protruding length of the sheet bundle can be shortened. As a result, the sheet processing device that has the folded back face processing device 430 has less deformation such as the folded back portion escaping even when pressing the folded back portion with the pressing roller, and the folded back portion can be more easily flattened down.

Folded Back Face Processing Device of Fifth Embodiment (Configuration of Folded Back Face Processing Device of Fifth Embodiment)

As illustrated in FIGS. 16A through 16F, the folded back face processing device 530 of the present embodiment differs from the configuration of the folded back face processing devices 130, 230, 330, and 430 of the first through the fourth embodiments in that the gripping roller pair 504 and 505 is formed with flat faces 504*b* and 505*b*, and flat faces 504*d* and 505*d*.

Figure 16A:
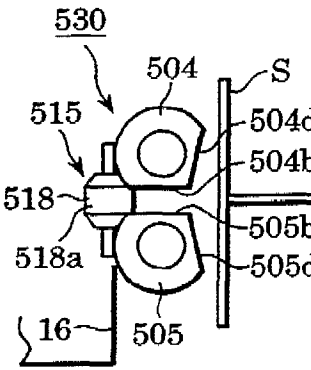
FIGS. 16A through 16F are front view schematic diagrams and action description diagrams of the folded back face processing device according to a fifth embodiment.
Figure 16B:
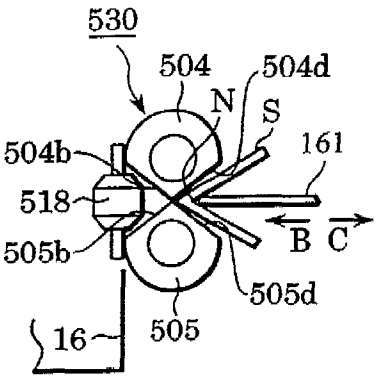
Figure 16C:
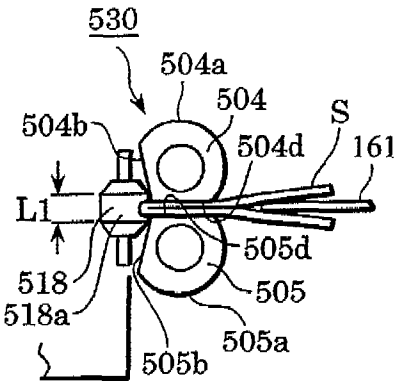
Figure 16D:
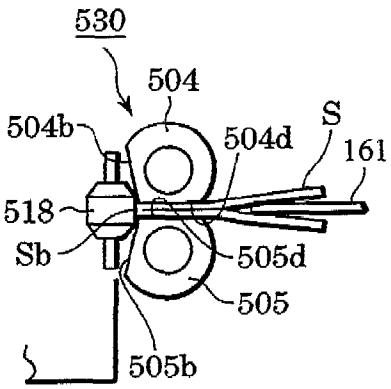

The flat faces 504*b* and 505*b* are formed along the direction of thrust of the gripping roller pair 504 and 505, as illustrated in FIGS. 16C and 16D, and are formed in the position to face the pressing roller 107 when the gripping roller pair 504 and 505 protrudes the folded back portion Sb from the nip portion N and temporarily stops the conveying of the sheet bundle. Further, these fulfill similar functions to those of the flat faces 204*b* and 205*b* of the gripping roller pair 204 and 205 illustrated in FIGS. 11C and 11D.

The flat faces 504*d* and 505*d* are formed along the direction of thrust of the gripping roller pair 504 and 505, as illustrated in FIGS. 16C and 16D, and are the portions that grip the sheet bundle. Further, these fulfill similar functions to those of the flat faces 404*d* and 405*d* of the gripping roller pair 404 and 405 illustrated in FIGS. 15C and 15D.

Now, with the folded back face processing device 530 of the present embodiment, the sensor flag that determines the relative position of the flat faces 504*d* and 505*d* and the folded back portion Sb of the sheet bundle S, and the rotating position sensor by which the rotating position of this sensor flag is detected are not illustrated in the diagram, but are similar to that of the folded back face processing device 230 of the second embodiment. However, the relative position relationship between the flat face 505*d* and the sensor flag differs from the relative position relationship between the flat face 205*b* according to the second embodiment and the sensor flag thereof.

Further, in order to lengthen the periphery faces 504*a* and 505*a*, the flat faces 504*d* and 505*d* are bent rather than being in a straight line, in the state of gripping the sheet bundle with the flat faces 504*d* and 505*d*. Therefore, the pressing roller 518 of the pressing device 415 that is a pressing unit sets the length (L1) of the rotating face 518*a* that flattens down the folded back portion Sb as the length that can enter between the flat faces 504*d* and 505*d*. Now, the pressing roller 518 does not necessarily need to be at the length that can enter between the periphery faces 504*a* and 505*a* of the gripping roller pair 504 and 505 as does the pressing roller 7 illustrated in FIG. 2C.

(Operations of Folded Back Face Processing Device of Fifth Embodiment)

The gripping roller pair 504 and 505, serving as a conveying rotary member pair making up the gripping device 514 which is a gripping unit, is rotated by the roller drive motor to position the flat faces 504*d* and 505*d* perpendicular to the abutting plate 161, and waits for the sheet bundle to be sent through (FIG. 16A). This position is the home position of the gripping roller pair 504 and 505.

The bound sheet bundle S is sent through from the upstream direction, and the portion bound with a stapler faces the tip of the abutting plate 161. The gripping roller pair 504 and 505 begins rotating. The abutting plate 161 that has pushed the sheet bundle between the rotating gripping roller pair 504 and 505 retreats in the direction of the arrow C (FIG. 16B). The gripping roller pair 504 and 505 rotates, grips, and conveys the sheet bundle with the nip portion N.

At the point when the flat faces 504*d* and 505*d* are facing one another and have become parallel, the gripping roller pair 504 and 505 stops rotating while still gripping the sheet bundle with the flat faces 504*d* and 505*d* (FIG. 16C). At this time, the sheet bundle is gripped by the flat faces 504*d* and 505*d*, and folded to have a booklet-like form. Further, the folded back portion Sb protrudes from the gripping roller pair 504 and 505 to the position to be pressed by the pressing roller 518. Further, the flat faces 504*b* and 505*b* are in the position capable of receiving the pressing roller 518.

After this, the pressing roller 518 rotates and moves along the folded back portion Sb, while pressing the folded back portion Sb (FIG. 16D). The folded back portion Sb of the sheet bundle is pressed by the pressing roller 518 while in the state of being gripped by the gripping roller pair 504 and 505. The cross-sectional form of the folded back portion area is a somewhat square shape with essentially no bulging.

Figure 16E:
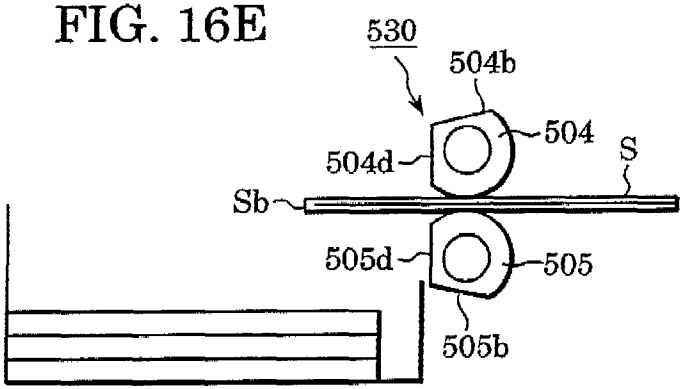
Figure 16F:
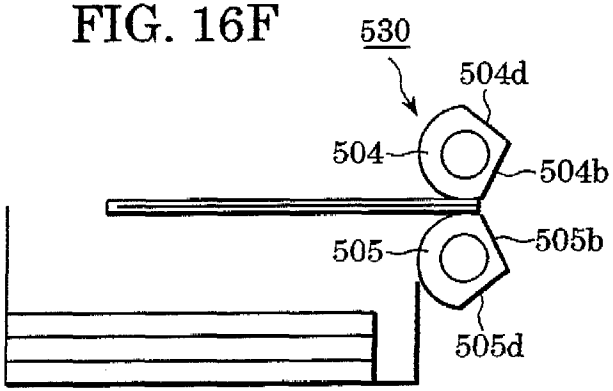
Figure 17:
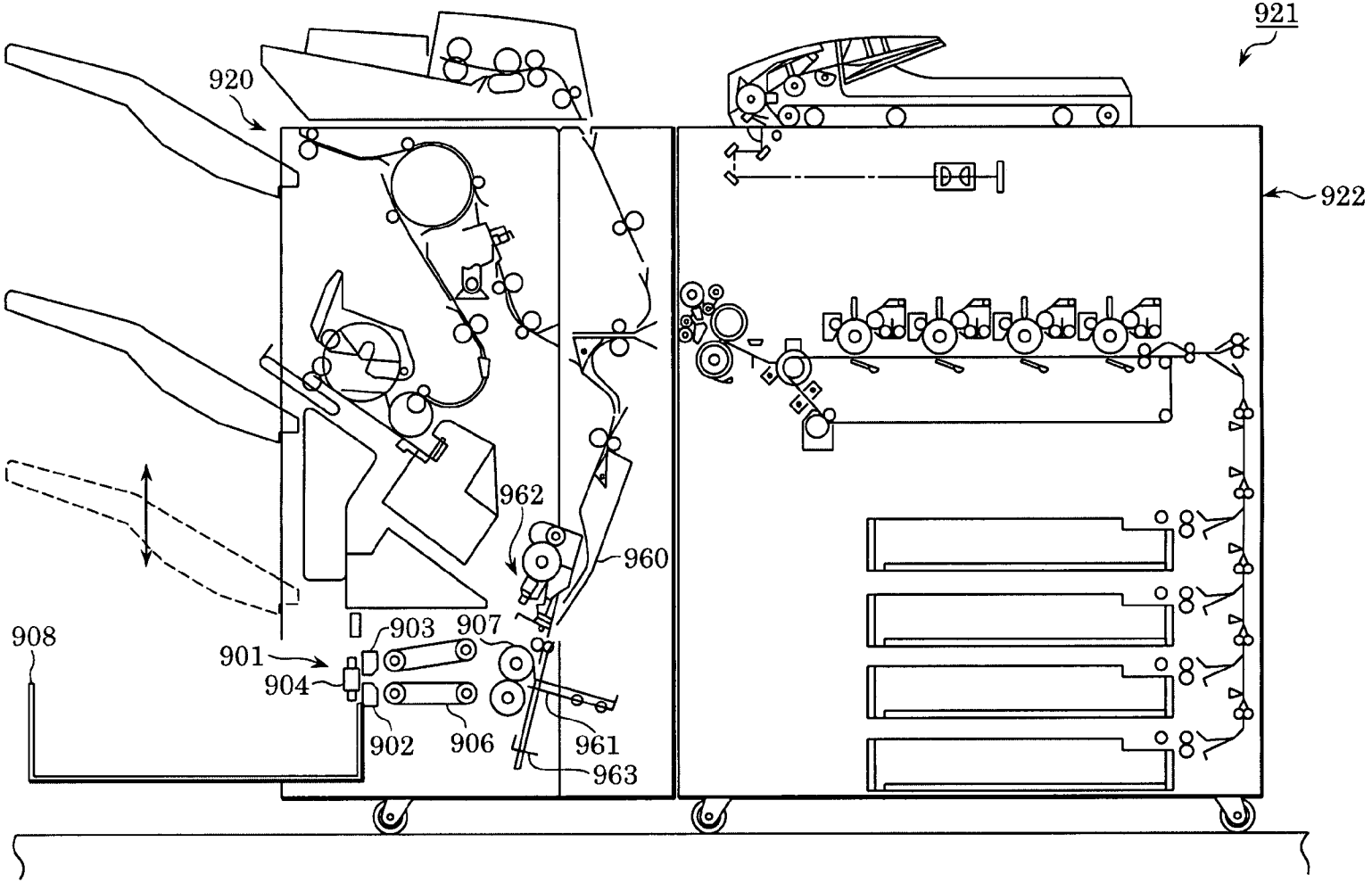
FIG. 17 PRIOR ART
FIG. 17 is a front view cross-sectional schematic diagram of a photocopier that is one example of a conventional image formation apparatus.
Figure 18:
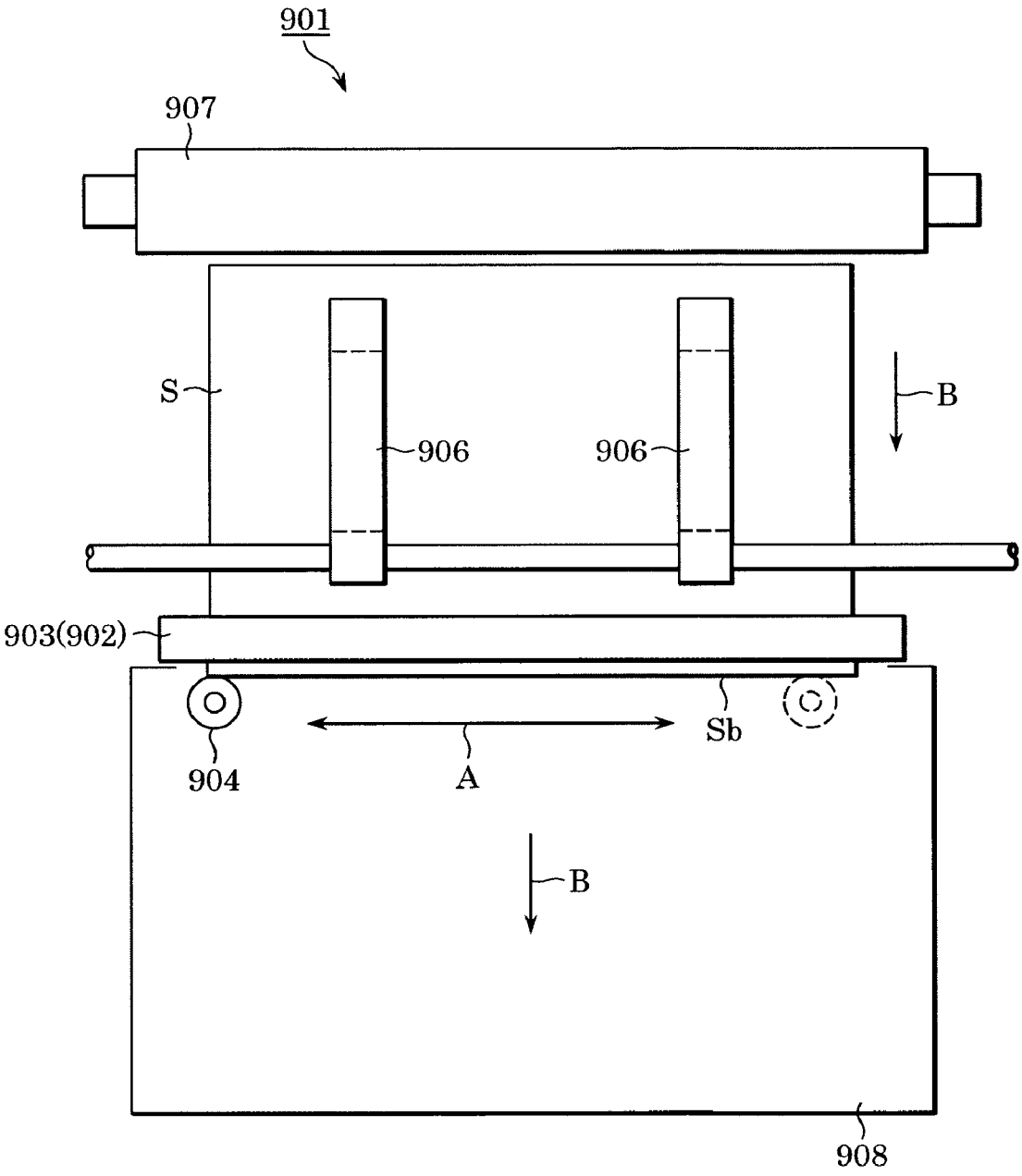
FIG. 18 PRIOR ART
FIG. 18 is a plan view of a folded back portion flattening processing device included in a sheet processing device of a conventional photocopier.
Figure 19A:
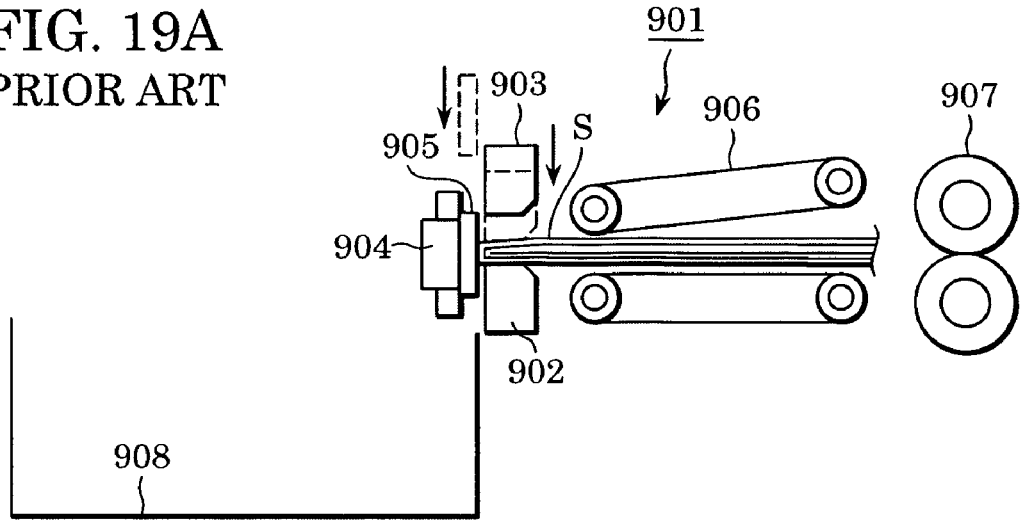
FIG. 19A PRIOR ART
FIGS. 19A through 19C are front views of the folded back portion flattening processing device illustrated in FIG. 18.
Figure 19B:
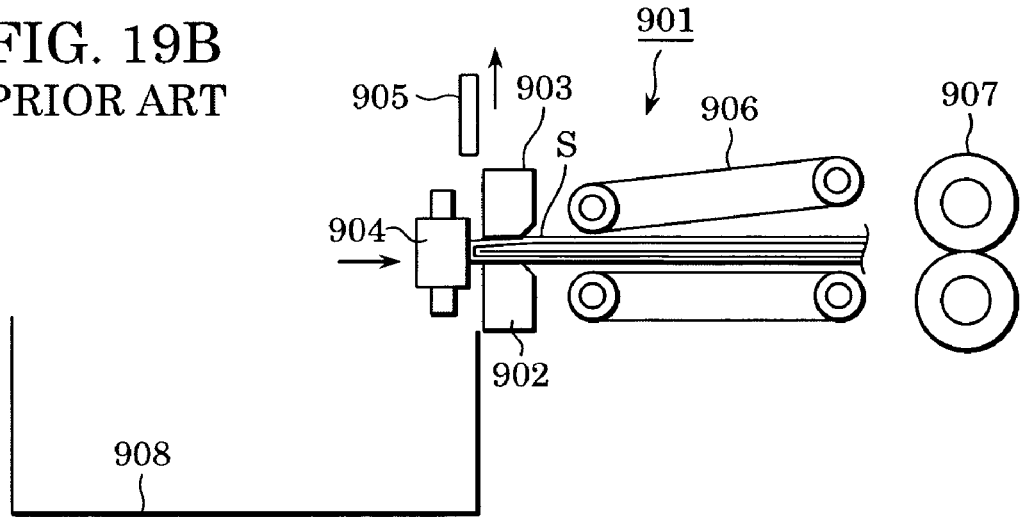
FIG. 19B PRIOR ART
Figure 19C:
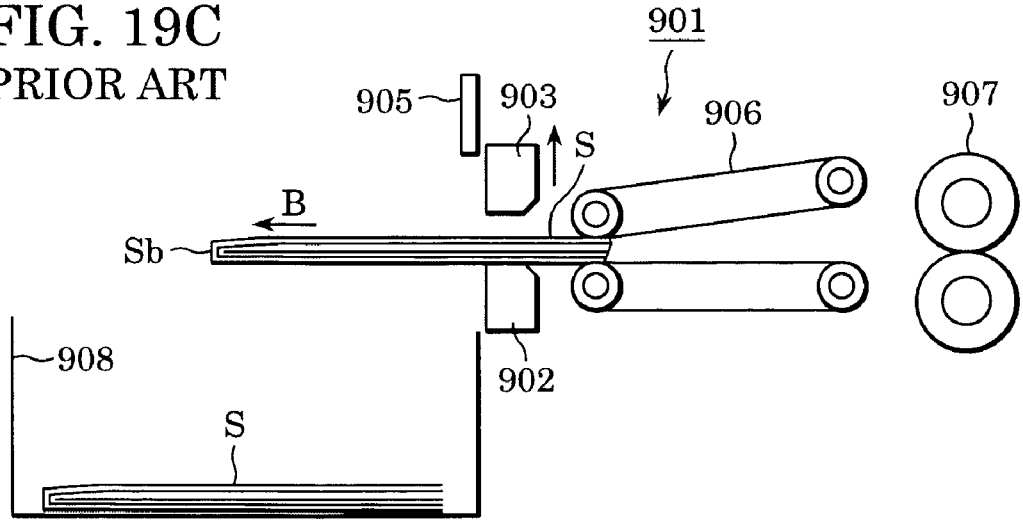
FIG. 19C PRIOR ART
Figure 20:
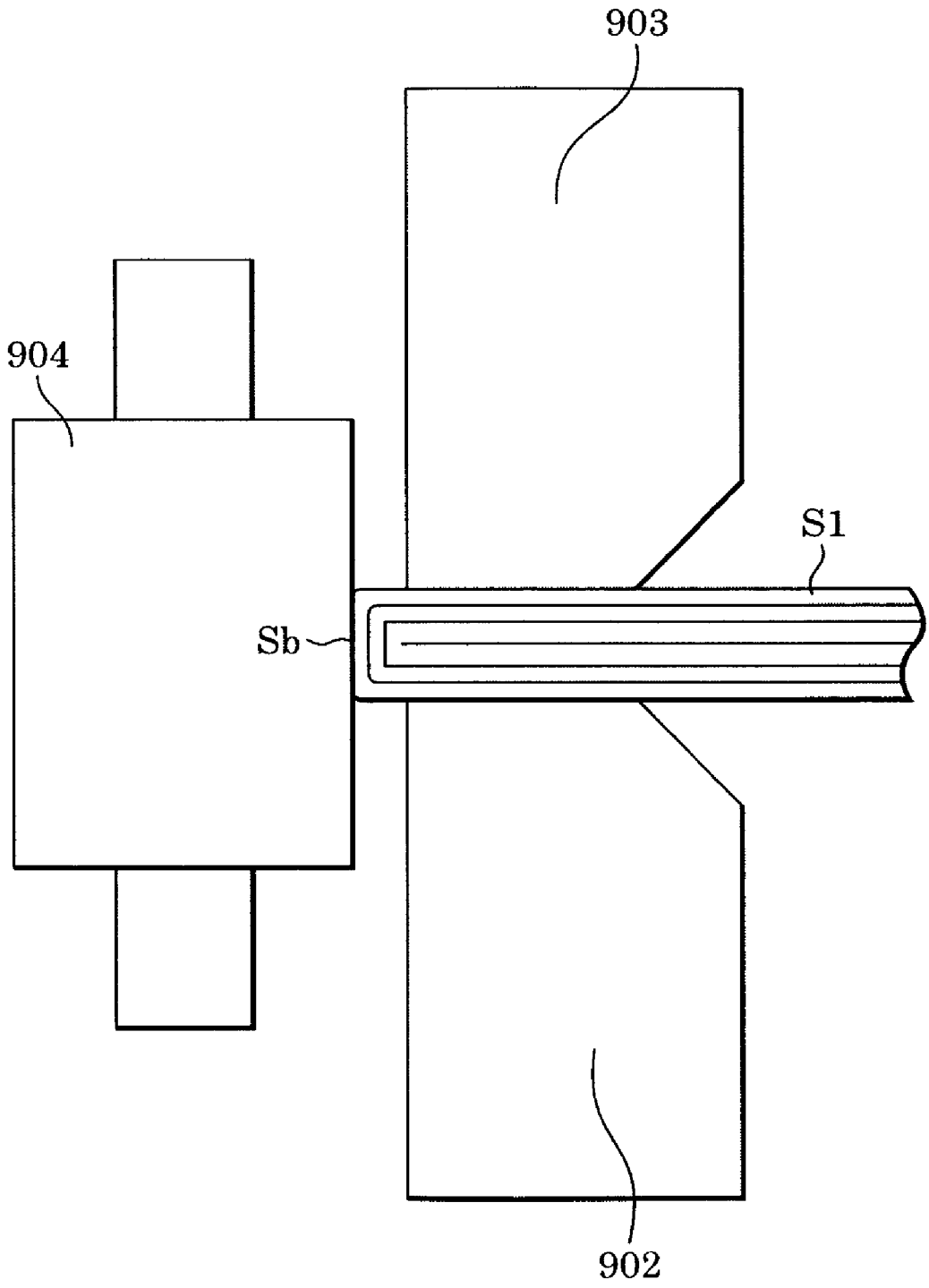
FIG. 20 PRIOR ART
FIG. 20 is an enlarged schematic view of the folded back portion in FIG. 19.

When the flattening processing of the folded back portion Sb by the pressing roller 518 ends, the gripping roller pair 504 and 505 rotates and conveys the sheet bundle S (FIGS. 16E and 16F). The sheet bundle S is discharged to the discharge tray 16.

After this, in the case that a subsequent sheet bundle exists, the gripping roller pair 504 and 505 returns to the state of FIG. 14A. In the case of no subsequent sheet bundle, the folded back face processing device 530, the sheet processing device 102, and the photocopier 101 end their actions.

As illustrated in FIG. 16C, the above-described folded back face processing device 530 of the present embodiment is such that the sheet bundle is gripped by the flat faces 504*d* and 505*d* of the gripping roller pair 504 and 505. Therefore, with the sheet processing device that has the folded back face processing device 530 of the present embodiment, the risk of the sheet bundle being pressed by the pressing roller 518 and pushed into the gripping roller pair 504 and 505 is reduced, and therefore a folded back portion Sb with a flat form can be made more easily.

Additionally, as illustrated in FIGS. 16A through 16F, with the above described folded back face processing device 530 of the present embodiment, the pressing roller 518 faces the flat faces 504*a* and 505*a* of the gripping roller pair 504 and 505, and is placed near the gripping roller pair 504 and 505, and therefore the length that the sheet bundle protrudes from the gripping roller pair 504 and 505 can be shortened. Therefore, with the sheet processing device that has the folded back face processing device 530 of the present embodiment, even when the pressing roller 518 flattens down the folded back portion, deformation such as the folded back portion escaping occurs less, the folded back portion can be more easily flattened down, and the quality of the folded back portion can be improved.

Further, the pressing roller 518 is set to a length that can enter between the flat faces 504*b* and 505*b*, and therefore, the pressing roller 518 can be brought that much closer to the gripping roller pair 504 and 505, and the protruding length of the sheet bundle can be shortened. As a result, the sheet processing device that has the folded back face processing device 530 has less deformation such as the folded back portion escaping, even when the folded back portion is flattened down with the pressing roller, and the folded back portion can be more easily flattened down.

Now, the folded back face processing devices 130, 230, 330, 430, and 530 according to the various embodiments above use a pressing roller 107, 418, or 518 as a pressing unit to flatten down the folded back portion of the sheet bundle, but a belt that circulates while moving, having a linear portion greater than the width of the sheets of which the folded back portion is to be pressed down, may be used. In the case of using a belt, the width of the belt should be a width that can enter between the periphery of the gripping roller pair, in order to correspond to the gripping rollers 418 and 518. Alternatively, the pressing unit may be a member in a spatula form or a member in a cylindrical form.

Further, the gripping roller pair should have at least one roller that is resilient or that can move away, in order to facilitate receiving the sheet bundle. In this case the roller pair needs to have only sufficient gripping force so that the position of the sheet stack does not shift even when the gripped sheet bundle is pressed by the pressing roller.

Further, the folded back face processing devices 130, 230, 330, 430, and 530 according to the various embodiments above are such that the folded back portion of the sheet bundle that has been bound with the stapler 62 is flattened down. However, sheet bundles that are not bound in the middle and perfect-binding sheet bundles can also have the folded back portion flattened down.

Note that the shape of a roller is expressed as "having a notch wherein the cross-section has a notched periphery", this means that the roller is of a shape with a notched form, and does not necessarily mean that a roller was actually cut to form it. The roller may also include shapes that appear notched, by drawing or molding formation techniques.

While the present invention has been described with reference to exemplary embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

This application claims priority from Japanese Patent Application No. 2004-055559 filed Feb. 27, 2004, which is hereby incorporated by reference herein.

What is claimed is:

1. A sheet processing device operable to process a sheet bundle having a folded back portion, comprising:

a pair of conveying rollers, having a periphery with a notch formed by first and second flat faces that intersect one another, configured to convey the sheet bundle;

a pressing unit configured to press the folded back portion of the sheet bundle gripped by the pair of conveying rollers; and a control unit controlling a rotation of the pair of conveying rollers, wherein the control unit controls the rotation of the pair of conveying rollers to stop conveying the sheet bundle when the folded back portion protrudes from the pair of conveying rollers by a predetermined amount, and controls the rotation of the pair of conveying rollers such that when the folded back portion is protruding from the pair of conveying rollers by the predetermined amount, the first flat face is positioned facing the pressing unit and the second flat face is positioned to grip the sheet bundle, and wherein the pressing unit presses the folded back portion protruding from the pair of conveying rollers while the pair of conveying rollers is stopped and is gripping the sheet bundle.

2. A sheet processing device according to claim 1, further comprising a detecting unit configured to detect whether the folded back portion is protruding from the pair of conveying rollers by the predetermined amount, wherein the control unit controls the rotation of the pair of conveying rollers responsive to detection results from the detecting unit.

3. A sheet processing device according to claim 1, wherein the pressing unit includes a roller configured to press along the folded back portion and having a pressing surface adapted to press the folded back portion, and wherein the length of the pressing surface of the roller is shorter than a distance between the pair of conveying rollers.

4. A sheet processing device according to claim 1, further comprising a folding unit configured to fold the sheet bundle, wherein the pair of conveying rollers rotates while gripping the sheet bundle folded by the folding unit.

5. A sheet processing device according to claim 1, wherein the pair of conveying rollers conveys the sheet bundle while folding the sheet bundle.

6. A sheet processing device according to claim 1, further comprising an abutting member adapted to abut the sheet bundle and to cooperate with the pair of conveying rollers to fold the sheet bundle, wherein the pair of conveying rollers receives, grips and conveys the sheet bundle abutted by the abutting member.

7. An image formation apparatus, comprising:

an image forming unit configured to form an image on a sheet; and the sheet processing device according to claim 1, wherein the sheet processing device is operable to process the folded back portion of the sheet bundle having the images formed thereon by the image forming unit.

8. An image formation apparatus according to claim 7, wherein the sheet processing device includes a detecting unit configured to detect whether the folded back portion is protruding from the pair of conveying rollers by the predetermined amount, and wherein the control unit controls the rotation of the pair of conveying rollers responsive to detection results from the detecting unit.

9. An image formation apparatus according to claim 7, wherein the sheet processing device includes a folding unit configured to fold the sheet bundle, wherein the pair of conveying rollers rotates while gripping the sheet bundle folded by the folding unit.

10. An image formation apparatus according to claim 7, wherein the sheet processing device includes an abutting member adapted to abut the sheet bundle and to cooperate with the pair of conveying rollers to fold the sheet bundle, wherein the pair of conveying rollers receives, grips and conveys the sheet bundle abutted by the abutting member.

11. An image formation apparatus, comprising:

an image forming unit configured to form an image on a sheet;

a sheet processing device operable to process a sheet bundle having a folded back portion; and a control unit controlling the sheet processing device, the sheet processing device including:

a pair of conveying rollers, having a periphery with a notch formed by first and second flat faces that intersect one another, configured to convey the sheet bundle; and a pressing unit configured to press the folded back portion of the sheet bundle gripped by the pair of conveying rollers, wherein the control unit controls a rotation of the pair of conveying rollers to stop conveying the sheet bundle when the folded back portion protrudes from the pair of conveying rollers by a predetermined amount, and controls the rotation of the pair of conveying rollers such that when the folded back portion is protruding from the pair of conveying rollers by the predetermined amount, the first flat face is positioned facing the pressing unit and the second flat face is positioned to grip the sheet bundle, and wherein the pressing unit presses the folded back portion protruding from the pair of conveying rollers while the pair of conveying rollers is stopped and is gripping the sheet bundle.

12. An image formation apparatus according to claim 11, wherein the sheet processing device includes a detecting unit configured to detect whether the folded back portion is protruding from the pair of conveying rollers by the predetermined amount, and wherein the control unit controls the rotation of the pair of conveying rollers responsive to detection results from the detecting unit.

13. An image formation apparatus according to claim 11, wherein the pressing unit includes a roller configured to press along the folded back portion and having a pressing surface adapted to press the folded back portion, and wherein the length of the pressing surface of the roller is shorter than a distance between the pair of conveying rollers.

14. An image formation apparatus according to claim 11, wherein the sheet processing device includes a folding unit configured to fold the sheet bundle, and wherein the pair of conveying rollers rotates while gripping the sheet bundle folded by the folding unit.

15. An image formation apparatus according to claim 11, wherein the sheet processing device includes an abutting member adapted to abut the sheet bundle and to cooperate with the pair of conveying rollers to fold the sheet bundle, and wherein the pair of conveying rollers receives, grips and conveys the sheet bundle abutted by the abutting member.

16. An image formation apparatus according to claim 11, wherein the pair of conveying rollers conveys the sheet bundle while folding the sheet bundle.

* * * * *